US007538635B2

(12) United States Patent
Fukuda et al.

(10) Patent No.: US 7,538,635 B2
(45) Date of Patent: May 26, 2009

(54) QUADRATURE HYBRID CIRCUIT HAVING VARIABLE REACTANCES AT THE FOUR PORTS THEREOF

(75) Inventors: Atsushi Fukuda, Yokohama (JP); Hiroshi Okazaki, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 290 days.

(21) Appl. No.: 11/397,723

(22) Filed: Apr. 5, 2006

(65) Prior Publication Data

US 2006/0232359 A1 Oct. 19, 2006

(30) Foreign Application Priority Data

Apr. 11, 2005 (JP) ..... 2005-113792

(51) Int. Cl.
*H01P 5/22* (2006.01)

(52) U.S. Cl. ..... 333/117; 333/111; 333/118; 333/120

(58) Field of Classification Search ..... 333/111, 333/117, 118, 120
See application file for complete search history.

(56) References Cited

U.S. PATENT DOCUMENTS

| | | | | |
|---|---|---|---|---|
| 2,424,156 | A | 7/1947 | Espley | |
| 5,304,961 | A | 4/1994 | Dydyk | |
| 5,363,071 | A * | 11/1994 | Schwent et al. | 333/111 |
| 5,400,002 | A | 3/1995 | Takahashi et al. | |
| 5,481,231 | A * | 1/1996 | Dydyk et al. | 333/112 |
| 6,097,266 | A | 8/2000 | Nardozza et al. | |
| 6,335,662 | B1 * | 1/2002 | Del Rosario et al. | 333/111 |
| 2003/0034858 | A1 | 2/2003 | Zhu | |
| 2005/0052259 | A1 | 3/2005 | Okazaki et al. | |

FOREIGN PATENT DOCUMENTS

| | | |
|---|---|---|
| EP | 0 573 985 A1 | 12/1993 |
| JP | 64-080101 | 3/1989 |
| JP | H01-088501 | 6/1989 |
| JP | 05-067904 | 3/1993 |
| JP | 05-251964 | 9/1993 |
| JP | 6-216687 | 8/1994 |
| JP | 7-30598 | 1/1995 |
| JP | 07-226609 | 8/1995 |
| JP | 8-43365 | 2/1996 |
| JP | 08-097602 | 4/1996 |

(Continued)

OTHER PUBLICATIONS

U.S. Appl. No. 11/397,723, filed Apr. 5, 2006, Fukuda, et al.
P. Bhartia, et al., Hybrids and Couplers, Microwave Solid State Circuit Design, Second Edition, 2003, pp. 181-189 and cover page.

*Primary Examiner*—Benny Lee
(74) *Attorney, Agent, or Firm*—Oblon, Spivak, McClelland, Maier & Neustadt, P.C.

(57) ABSTRACT

Four variable reactance means are connected, respectively, to the four ports of a quadrature hybrid circuit which is composed of four ring-linked two-port circuits each composed of a transmission line or multiple lumped reactance elements, so that by changing the reactance values of the four variable reactance means, operating frequency of the quadrature hybrid circuit can be selectively changed.

15 Claims, 16 Drawing Sheets

FOREIGN PATENT DOCUMENTS

| | | |
|---|---|---|
| JP | 2000-209007 | 7/2000 |
| JP | 2000-295003 | 10/2000 |
| JP | 2002-076844 | 3/2002 |
| JP | 2002-368566 | 12/2002 |
| WO | 24 31 237 A1 | 1/1976 |
| WO | WO 03/017416 A1 | 2/2003 |

* cited by examiner

QUADRATURE HYBRID CIRCUIT HAVING VARIABLE REACTANCES AT THE FOUR PORTS THEREOF

FIELD OF THE INVENTION

The present invention concerns a quadrature hybrid circuit that can be used in multiple frequency bands, for instance, as a radio frequency band high frequency signal power divider, power combiner, phase shifter, or the like.

BACKGROUND

Quadrature hybrid circuits are widely used as power divider and/or combiner circuits for power dividing or power combining of high frequency signals in radio frequency bands. FIG. 23 shows a configuration of a branch-line type quadrature hybrid circuit (hereinafter referred to as quadrature hybrid circuit). Four transmission lines 180, 181, 182, 183 are interconnected in a ring, and the four junction points of said transmission lines serve as I/O terminals for high frequency signals.

Transmission line 180 is connected to terminal 1 (hereinafter referred to as port 1) on one side, and to terminal 2 (hereinafter referred to as port 2) on the other side. Transmission line 181 is connected to port 2 on one side, and to terminal 3 (hereinafter referred to as port 3) on the other side. Transmission line 182 is connected to port 3 on one side, and to terminal 4 (hereinafter referred to as port 4) on the other side. Transmission line 183 is connected between port 4 and port 1.

Transmission lines 180 and 182, and transmission lines 181 and 183, which are faced each other, are respectively configured with identical characteristic impedances. The coupling factor between Port 1 and Port 3 can be changed according to the ratio of the characteristic impedance of transmission lines 180 and 181.

For example, let us assume that an identical load (impedance $Z_0$) is connected to each of ports 2, 3, and 4, a signal source 184 with impedance $Z_0$ is connected to port 1, and a high frequency signal is input into port 1. If, at this time, the characteristic impedance of transmission line 181 is $Z_b$, and the characteristic impedance of transmission line 180 is $Z_a=Z_b/\sqrt{2}$, half of the power of the high frequency signal input into port 1 is output to port 3. The remaining half of the power is output to port 2, and the phase difference between the high frequency signals of port 2 and port 3 is 90 degrees. Attenuation to half of original signal power, expressed in decibels, is −3 dB. Therefore, such a circuit is referred to as a quadrature hybrid circuit with a coupling factor of 3 dB. Such a quadrature hybrid circuit is described on p. 185 of Microwave Solid State Circuit Design, Wiley-Interscience, John Wiley & Sons, Inc. (hereinafter referred to as non-patent document 1) as a quadrature hybrid, with the matching condition and the coupling factor leaded as equations (1) and (2).

$$\text{Matching condition: } Y_0^2=Y_a^2-Y_b^2 \quad (1)$$

$$\text{Coupling factor: } C=20\log_{10} Y_a/Y_b \quad (2)$$

In the above equations, $Y_0$ is the admittance expression for $Z_0$. Likewise, $Y_a$ and $Y_b$ are the admittance expressions for $Z_a$ and $Z_b$, respectively. As the characteristic impedance $Z_a$ of transmission line 180 is $Z_a=Z_b/\sqrt{2}$, the admittance $Y_a=\sqrt{2}Y_b$. Therefore, the coupling factor C is −3 dB.

By setting the ratio of admittance values as shown in equation (2) to a certain value in this manner, the circuit can be used as a power divider with the desired power division ratio.

Furthermore, the circuit can also be used as a power combiner whereby high frequency signals with a phase difference of 90 degrees are input into ports 2 and 3, and their combined signal is output from port 1. It can also be used as a phase shifter.

Japanese Patent Application Laid Open No. H07-30598 (hereinafter referred to as patent document 1) shows an example of a quadrature modulator comprising a combination of a quadratuer hybrid circuit and a mixer IC. A block diagram of the quadrature modulator described in patent document 1 is shown in FIG. 24. A carrier frequency signal is input into the input port IN of 90 degree phase shifter 190. Said 90 degree phase shifter 190 is comprised of a quadrature hybrid circuit. Outputs OUT1 and OUT2 of 90 degree phase shifter 190, which have a 90 degree phase difference from each other, are multiplied with modulating signals I and Q by multipliers 191 and 192, respectively, to produce modulated carrier waves with a 90 degree phase difference. The output signals of multipliers 191 and 192 are combined by adder 193 and the resulting signal is transmitted to the transmission amplifier circuit, which is not shown in the diagram. In this manner, a quadrature hybrid circuit is used, for instance, in a quadrature modulator, or the like.

Furthermore, Japanese Patent Application Laid Open No. H08-43365 (hereinafter referred to as patent document 2) shows an example of a multiple frequency band phase shifter comprised of multiple quadrature hybrid circuits, each for one of different frequency bands.

Patent document 1 shows in FIG. 25 an example of a quadrature hybrid circuit comprising lumped elements that are equivalent to transmission lines. The transmission line 180 shown in FIG. 23 is replaced with a π type circuit comprised of inductor 194 and capacitors 198 and 199 that are connected to either end of the inductor 194. Likewise, the transmission line 181 is replaced with a π type circuit comprised of inductor 195 and capacitors 199 and 200. The parts that correspond to transmission lines 182 and 183 are the same, so their explanation is omitted.

Here, the capacitors connected on one end to ports 1, 2, 3, 4 have been indicated in abbreviated notation. In brief, two capacitors each need to be connected on one side to each of ports 1, 2, 3, 4 to construct a π type circuit. However, said capacitors are of such capacitance that they are connected between the respective terminals and ground, so they are notated together as a single circuit symbol.

A quadrature hybrid circuit that is equivalent to one with transmission lines can be constructed with π type circuits whose admittance values conform to equations (1) and (2).

As stated in paragraph [0014] of patent document 2, quadrature hybrid circuits have the drawbacks that they can only be used in a limited frequency range, and cannot be used for broad bands. For this reason, multiple quadrature hybrid circuits have conventionally been placed side by side to support multiple frequency bands. Specifically, a configuration with multiple quadrature hybrid circuits, each with all four transmission lines shown in FIG. 23, designed to support a specific frequency band, has been used. Otherwise, when lumped elements are used, there has been a need for multiple quadrature hybrid circuits comprised of inductors and capacitors designed with constants adjusted to each frequency. Therefore, the large size of the resulting circuit has remained a challenge.

In particular, a quadrature hybrid circuit requires a large surface area due to its rectangular shape, as shown in FIG. 23. This is because the transmission lines from each port need to be the same length and space is inevitably wasted in the center of the rectangle. Therefore, multiple use of such circuits necessitates an extremely large circuit surface area.

SUMMARY OF THE INVENTION

The present invention has been made in consideration of the above issues, and aims to provide a quadrature hybrid circuit that has four two-port circuits interconnected in a ring configuration as in prior art, but is usable in multiple frequency bands.

The quadrature hybrid circuit of the present invention is comprised such that:

four two-port circuits interconnected in a ring, four junction points of the four two-port circuits defining four ports of the quadrature hybrid circuit, and the four two-port circuits being configured so that a high frequency signal input from one of the four ports is output from two of the other ports at an equal level with a mutual phase difference of 90 degrees; and four variable reactance means each connected to corresponding one of said four ports.

A quadrature hybrid circuit that can be used in multiple frequency bands by changing the reactance value of the variable reactance means is realized by such a configuration. Specifically, the circuit surface area can be reduced because the part of the circuit that is connected in a ring and thus requires a large circuit surface area can be commonly used for multiple frequency bands.

DETAILED DESCRIPTION OF THE PREFERRED EMBODIMENTS

Embodiments of the present invention are explained below using diagrams. Corresponding parts of the diagrams are given identical reference numbers in the different drawing figures and corresponding description may be omitted to avoid repetitive explanations.

[Basic Configuration]

Figure 1:
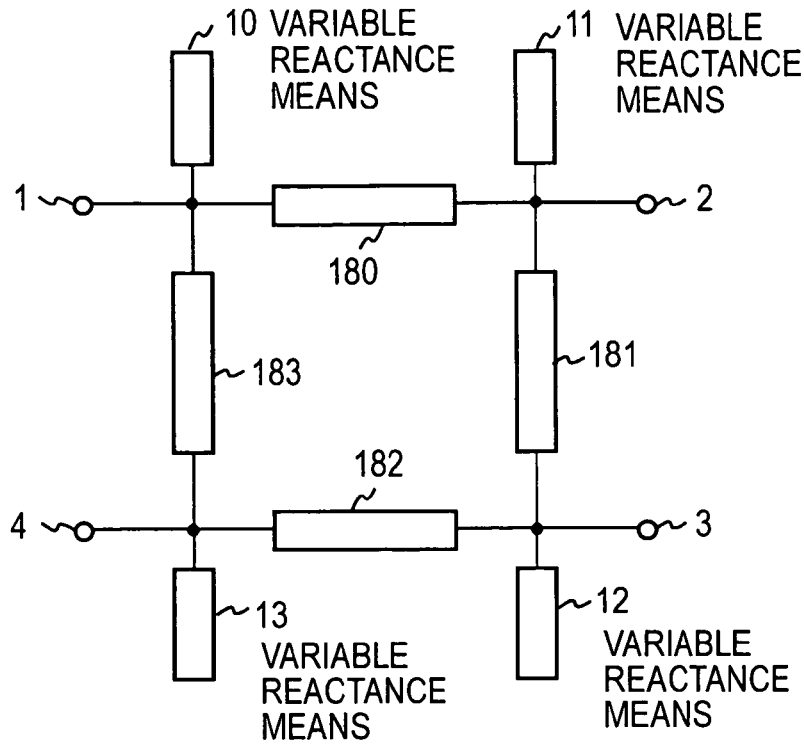
FIG. 1 is a diagram showing the basic configuration of the quadrature hybrid circuit according to the present invention.

FIG. 1 shows the basic configuration of a quadrature hybrid circuit according to the present invention. Variable reactance means 10, 11, 12, 13 are connected to ports 1, 2, 3, 4, which are the junction points between the four transmission lines 180, 181, 182 and 183 that are joined together in a ring, indicated as an example of a conventional quadrature hybrid circuit. The interconnection and size relationships of the transmission lines 180, 181, 182, 183 are also identical to those described for prior art. In the following explanations as well, the ring-shaped interconnection and size relationships of the transmission lines 180, 181, 182, 183 are also identical, so explanations of the transmission lines 180, 181, 182, 183 shall be omitted.

One end of variable reactance means 10 is connected to port 1, to which one ends transmission lines 180 and 183 are connected. One end of variable reactance means 11 is connected to port 2, to which the other end of transmission line 180 and one end of transmission line 181 are connected. One end of variable reactance means 12 is connected to port 3, to which the other end of transmission line 181 and one end of transmission line 182 are connected. One end of variable reactance means 13 is connected to Port 4, to which the other ends of transmission lines 182 and 183 are connected.

By setting the reactance value of each of the variable reactance means 10, 11, 12, 13 to a specific equal value, the operating frequency of the quadrature hybrid circuit between ports 1, 2, 3, 4 can be changed.

Embodiments of variable reactance means 10, 11, 12, 13 are described below with reference to the drawings.

First Embodiment

Figure 2:
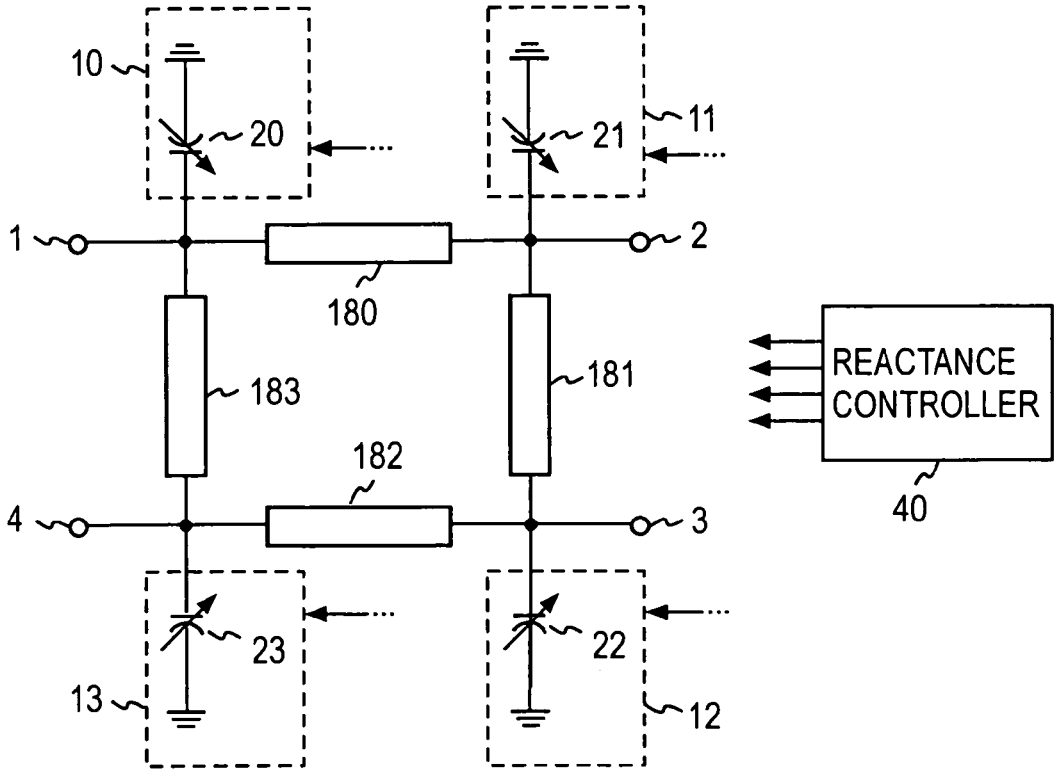
FIG. 2 is a diagram of a first embodiment of the present invention.

FIG. 2 shows an example of variable reactance means 10, 11, 12, 13 comprised of variable capacitance elements. One end of each of variable capacitance elements 20, 21, 22, 23 is connected to corresponding one of ports 1, 2, 3, 4, and the other end of each variable capacitance element is grounded.

The reactance of variable reactance means 10, 11, 12, 13 is controlled by a reactance controller 40. In this embodiment, reactance controller 40 controls the capacitance of variable capacitance elements 20, 21, 22, 23. A reactance controller that controls the variable reactance means is also used in all other embodiments of the present invention described below, but it is omitted from the drawings for the sake of simplicity.

The variable capacitance elements 20, 21, 22, 23 may be, for instance, varactor elements that utilize changes in a semiconductor's depletion layer, or the like. They can be set to the desired capacitance value by controlling applied voltage. In the present example, for instance, transmission lines 180, 181, 182, 183 are designed, in accordance with equations (1) and (2), to operate as a quadrature hybrid circuit at a frequency of 2 GHz when the variable capacitance elements 20, 21, 22, 23 are in a state of minimum capacitance; i.e., when the capacitance of variable capacitance elements 20, 21, 22, 23 is negligible.

Figure 3A:
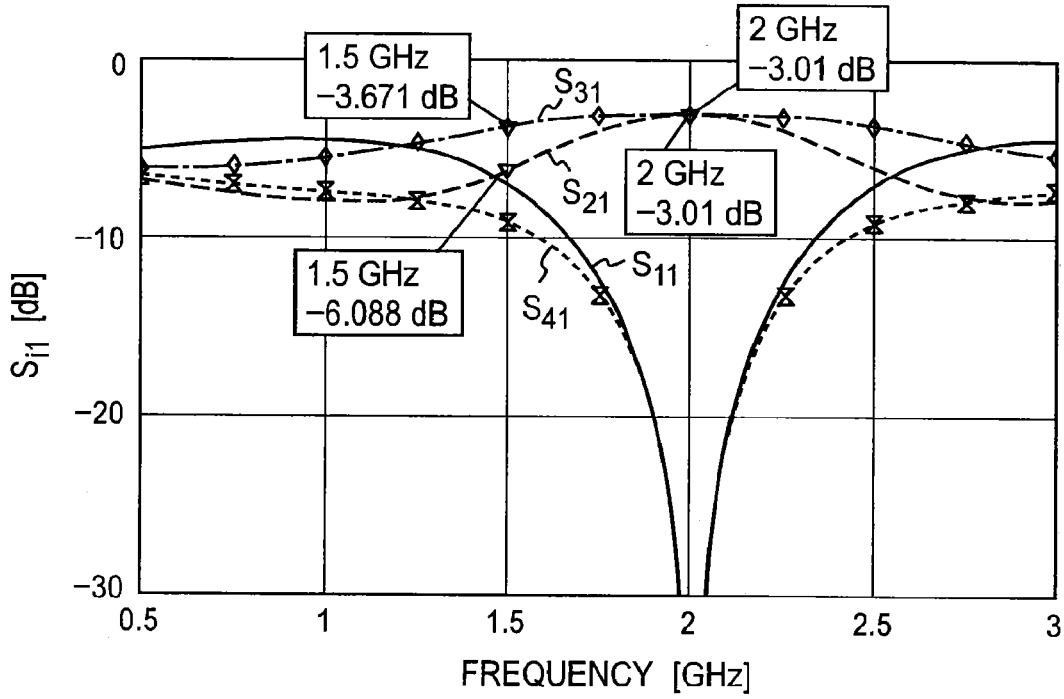
FIG. 3A is a diagram of frequency characteristics of amplitude corresponding to FIG. 2.
Figure 3B:
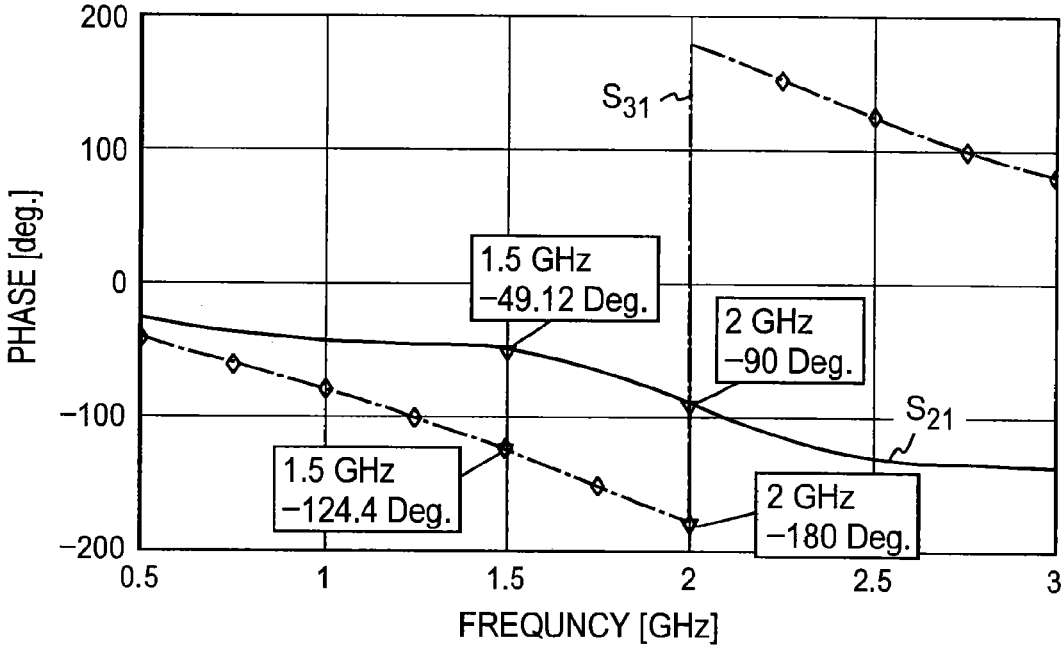
FIG. 3B is a diagram of frequency characteristics of phase corresponding to FIG. 2.

The frequency characteristics of transfer parameters when the capacitance of variable capacitance elements 20, 21, 22, 23 is negligible are shown in FIGS. 3A and 3B. FIG. 3A shows amplitude characteristics. The horizontal axis indicates the frequency in GHz, and the vertical axis indicates the transfer characteristic $S_{i1}$ as the scattering parameter (dB), which in FIG. 3A is the reflection coefficient or transmission coefficient, to port i (i=1, 2, 3, 4) in the case that a high frequency signal is input to port 1. $S_{11}$ represents the ratio of the returned signal to the input signal, i.e., the reflection, as the input terminal is port 1. $S_{11}$ is below −30 dB at a frequency of 2 GHz, so reflection is extremely low. $S_{21}$ and $S_{31}$ are both −3 dB (0.5), indicating that a high frequency signal with half the power of the signal input to port 1 is transferred. $S_{41}$, like $S_{11}$, exhibits a value below −30 dB at 2 GHz, indicating that the signal input from port 1 is hardly transferred to port 4. While, $S_2$, and $S_3$, are about −6.088 dB and −3.671 dB at 1.5 GHz.

FIG. 3B shows phase characteristics under the same conditions as FIG. 3A. Here the transfer characteristic $S_{i1}$ represents the phase difference between the high frequency signal output from port i and the high frequency signal input into port 1. In FIG. 3B, the horizontal axis indicates the frequency in GHz and the vertical axis indicates the phase in degrees. The figure shows that the transfer characteristic $S_{21}$ is −90 degrees at 2 GHz frequency, and likewise the transfer characteristic $S_{31}$ is −180 degrees at 2 GHz frequency. Thus, the phase difference between port 2 and port 3 is 90 degrees. While, S21 and S31 are about −49.12 degrees and −124.4 degrees at 1.5 GHz.

Figure 4A:
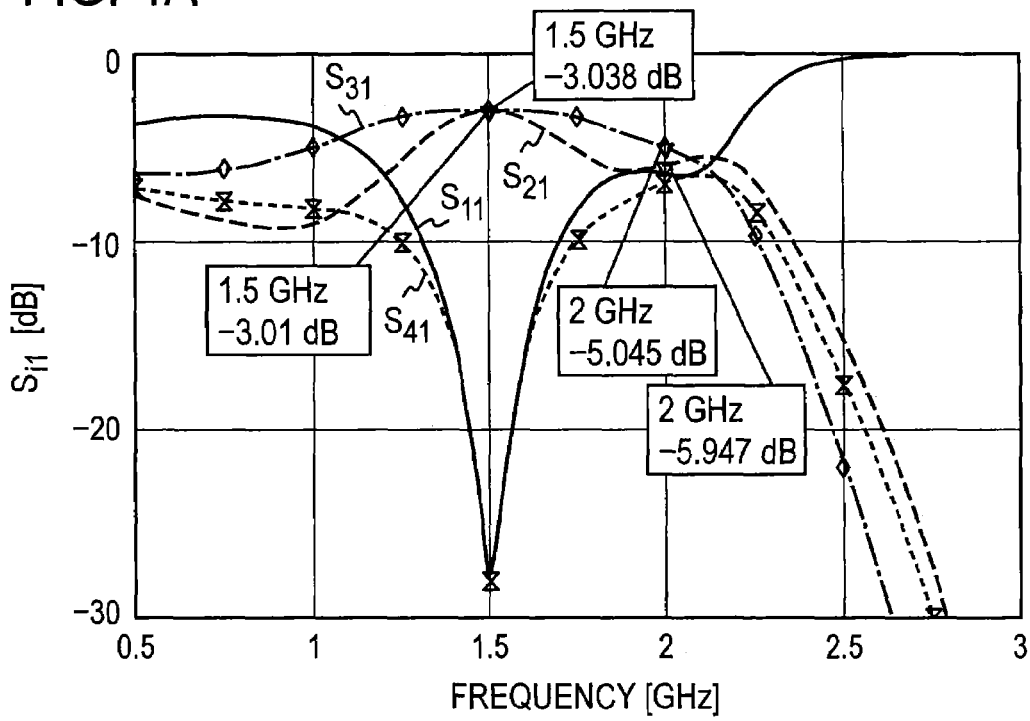
FIG. 4A is a diagram of frequency characteristics of amplitude corresponding to FIG. 2.
Figure 4B:
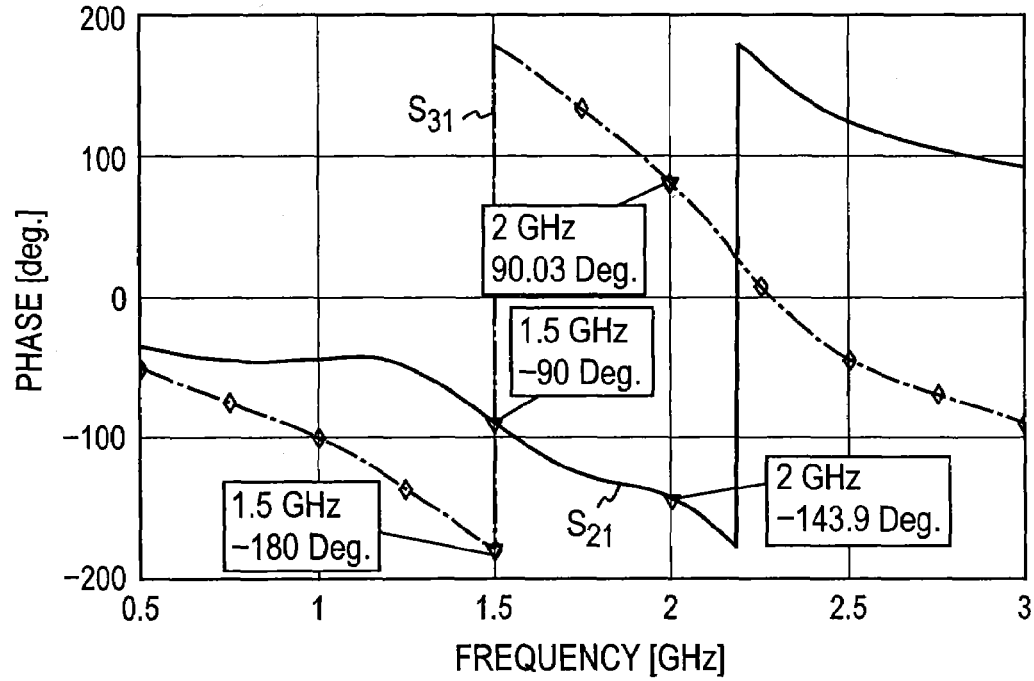
FIG. 4B is a diagram of frequency characteristics of phase corresponding to FIG. 2.

Next, the frequency characteristics when the capacitance value of variable capacitance elements 20, 21, 22 23 is increased from 0 to 2 pF due to control by reactance controller 40 is shown in FIGS. 4A and 4B. FIG. 4A shows the amplitude characteristics, with the same horizontal and vertical axes as FIG. 3A. Due to the 2 pF increase in the capacitance value of variable capacitance elements 20, 21, 22, 23, both $S_{21}$ and $S_{31}$ become −3 dB and both $S_1$ and $S_4$, become approximately −28 dB at a frequency of 1.5 GHz. On the other hand, $S_{21}$ and $S_{31}$ are approximately −5.947 dB and −5.045 dB, respectively and $S_{11}$ and $S_{41}$ are approximately −6 dB and −7.2 dB, respectively, at a frequency of 2 GHz. Thus, the operating frequency of the quadrature hybrid circuit has changed to 1.5 GHz.

FIG. 4B shows the phase characteristics under the same conditions. The horizontal and vertical axes are the same as in FIG. 3B. FIG. 4B shows that the transfer characteristic $S_{21}$ at a frequency of 1.5 GHz is −90 degrees and the transfer characteristic $S_{31}$ at a frequency of 1.5 GHz is −180 degrees. On the other hand, at a frequency of 2 GHz, $S_{21}$ is approximately −143.9 degrees and $S_{31}$ is approximately 90.03 degrees, showing that the frequency at which a 90 degree phase difference is obtained has changed to 1.5 GHZ, as with the amplitude characteristics.

As explained above, the operating frequency of a quadrature hybrid circuit can be changed by connecting variable reactance means 10, 11, 12, 13 comprised of variable capacitance elements 20, 21, 22, 23, to ports 1, 2, 3, 4 that are the respective junction points of transmission lines 180, 181, 182, and 183 interconnected in a ring, and by changing the capacitance value of said variable capacitance elements 20, 21, 22, 23.

Second Embodiment

Figure 5:
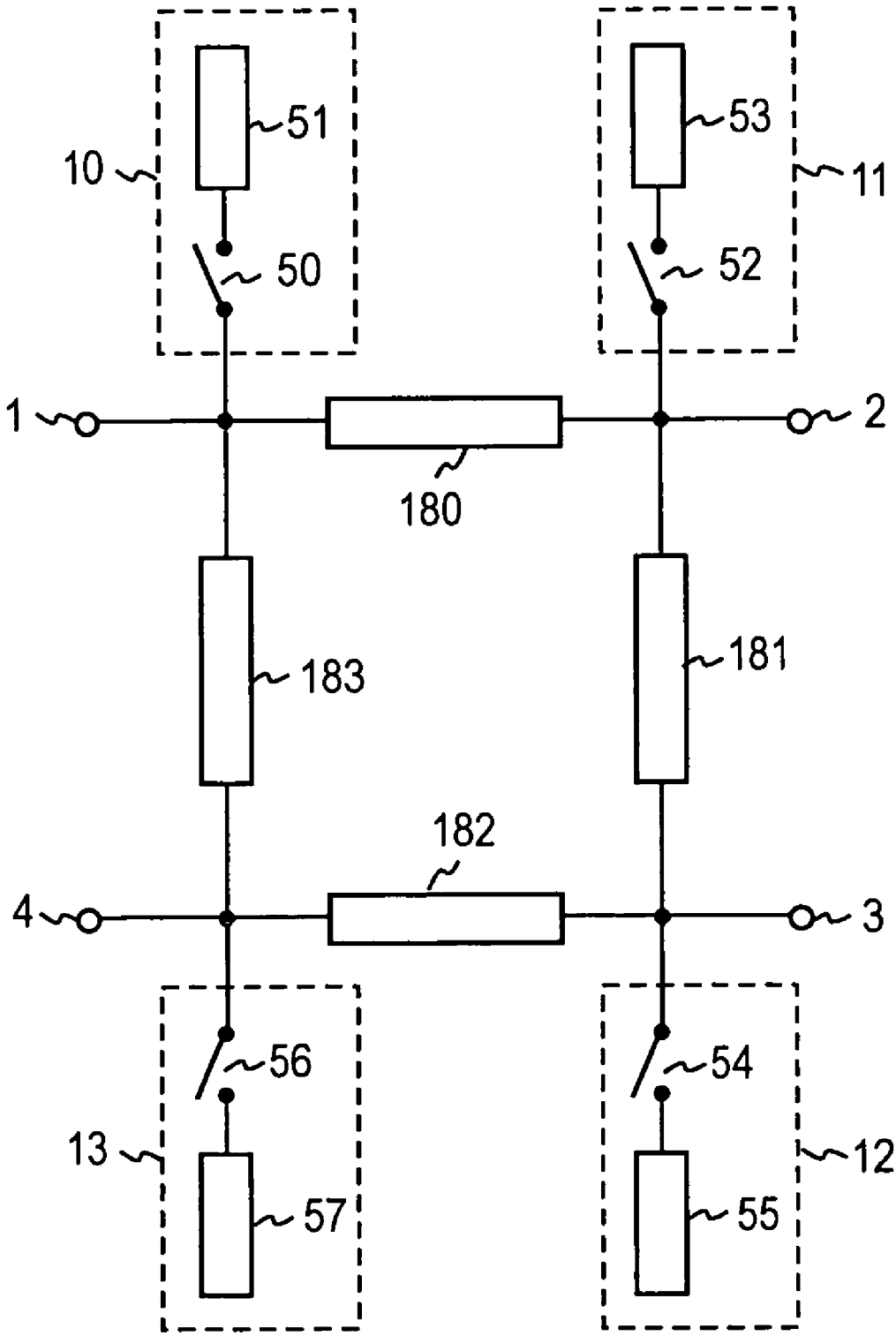
FIG. 5 is a diagram of a second embodiment of the present invention.

FIG. 5 shows a second embodiment of the present invention in which transmission lines are used as variable reactance means 10, 11, 12, 13. Variable reactance means 10 that is connected to port 1 is comprised of switch element 50 and transmission line 51. Variable reactance means 11 that is connected to port 2 is comprised of switch element 52 and transmission line 53. Variable reactance means 12 that is connected to port 3 is comprised of switch element 54 and transmission line 55. Variable reactance means 13 that is connected to port 4 is comprised of switch element 56 and transmission line 57. Switch elements 50, 52, 54 and 56 are placed between ports 1, 2, 3, 4 and transmission lines 51, 53, 55 and 57, respectively. The quadrature hybrid circuit shown in FIG. 5 is designed to have an operating frequency of 2 GHz when switch elements 50, 52, 54 and 56 are all in a non-conducting state, as stated above. In this state, the frequency characteristics of amplitude and phase are the same as those shown in FIGS. 3A and 3B. When all transmission lines 51, 53, 55 and 57, which operate as open end lines, are configured to have an electric length of approximately 60 degrees at a frequency of 2 GHz, and all switch elements 50, 52, 54 and 56 are switched to a conducting state, the operating frequency of the quadrature hybrid circuit is changed to 1.5 GHz. The frequency characteristics of amplitude and phase in this case are the same as in FIGS. 4A and 4B.

In this manner, the operating frequency of a quadrature hybrid circuit can also be changed by connecting reactance elements comprised of transmission lines instead of variable capacitance elements, which are lumped elements.

[Example of Switch Element]

The switch elements that connect, for instance, the transmission lines 51, 53, 55 and 57 to the ports 1 through 4 can be embodied by a semiconductor element such as a field effect transistor (FET), PIN diode, or the like, as well as by a mechanical switch using MEMS (Micro Electromechanical Systems) technology. An example that uses a switch element comprised of a Monolithic Microwave Integrated Circuit (hereinafter abbreviated as MMIC) is explained below.

Each switch element 50, 52, 54 and 56 shown in FIG. 5 is a Single Pole Single Throw Switch (hereinafter abbreviated as "SPST switch"). However, here is explained an example using Single Pole Double Throw Switches (hereinafter abbreviated as "SPDT switches"), which are convenient due to the layout of the quadrature hybrid circuit pattern, the switch elements 50, 52, 54 and 56 connected to it, and the transmission lines 51, 53, 55 and 57, all of which are formed on substrate 70 shown in FIG. 6.

Figure 6:
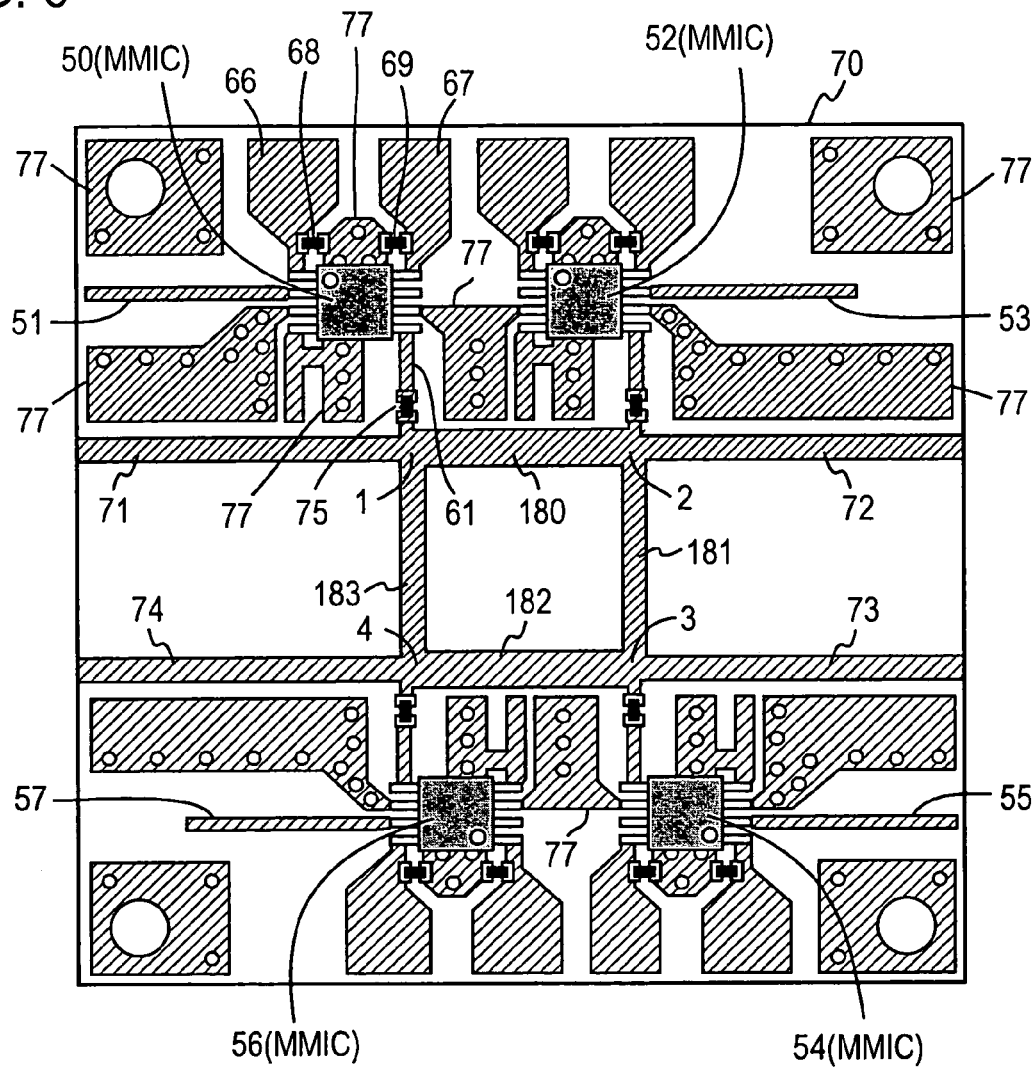
FIG. 6 is a diagram of a quadrature hybrid circuit pattern configured on a substrate, and switch elements mounted thereon.

As shown in FIG. 6, MMIC switch elements 50, 52, 54 and 56 are each arranged close to the ports 1, 2, 3, 4, respectively, so it is convenient to form the variable reactance means comprising, for instance, the transmission lines 51 and 53 in such a way that they extend out in opposite directions from opposite sides of the MMIC switch elements 50 and 52. The same can be said regarding the relationship of the MMIC switches 54 and 56 to the transmission lines 55 and 57. The SPDT switches are here used as MMIC switch elements 50, 52, 54 and 56 to enable such a layout.

Figure 7:
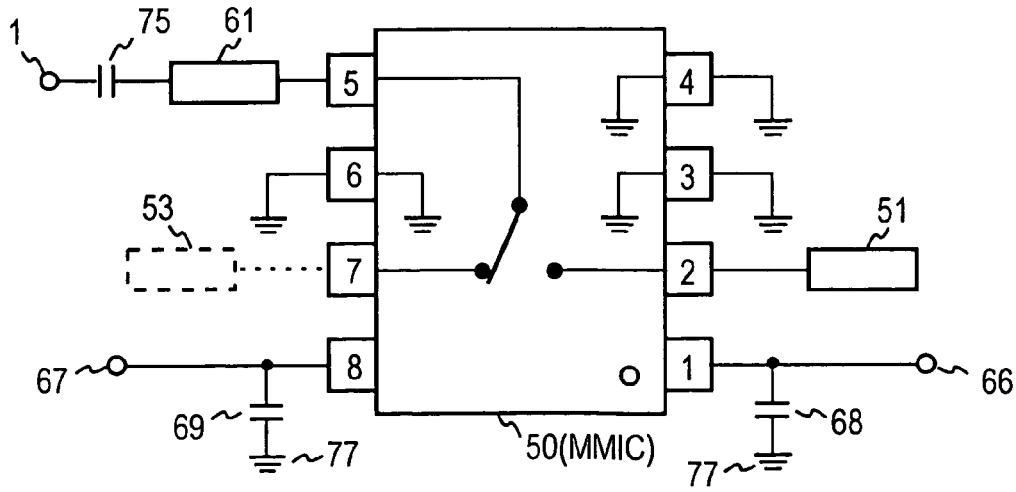
FIG. 7 is a diagram showing the configuration and connections of a switch element.

FIG. 7 is a diagram showing the pin numbers of an 8-pin plastic package that implements an MMIC formed as an SPDT switch, and the circuits connected to each of the pins. This example shows the case in which the switch element 50 is comprised of an SPDT switch. The rectangular parallelepiped plastic package of MMIC switch 50 has 4 pins protruding from each of the two long sides of the rectangular parallelepiped, for connection to the circuits on the substrate. A pin at one end of one of the sides with protruding pins is numbered 1 (indicated by a mark ○ near the pin), and the pin number is increased sequentially in counter-clockwise direction such that the pin that faces pin number 1 and is on the other side of the plastic package is numbered 8.

In FIG. 7, pin 5 is the single pole of the SPDT switch, and pins 2 and 7 are the double throw terminals. A transmission line 61 with characteristic impedance of 50Ω is connected on one end to pin 5, and on the other end to port 1 via chip condenser 75. The transmission line 51 is connected to pin 2. The variable reactance means 10 shown in FIG. 5 is comprised of the transmission line 51 and the MMIC switch element 50. Pin 1 and pin 8 are connected to control terminals 66 and 67, which control which of the dual throw elements the single pole junction point connects to. Coupling capacitors 68 and 69 are placed between said control terminals 66 and 67 and ground electrode 77 to prevent the high frequency signal or switching from being affected by electromagnetic noise that enters the wiring pattern from outside. Pins 3, 4 and 6 are grounded. Nothing is connected to pin 7.

It is possible to control which of the double throw terminals pin 2 and pin 7, the single pole pin 5 connects to, using a control signal applied to the control terminals 66 and 67 from a reactance controller not shown in the diagram. For instance, when a control signal of a high or H level is applied to the control terminal 66 and a control signal of a low or L level is applied to the control terminal 67, the pin 5 enters a conductive state with the pin 2. On the other hand, when a control signal of L level is applied to the control terminal 66 and a control signal of H level is applied to the control terminal 67, the pin 5 enters a conductive state with the pin 7.

Going back to FIG. 6, it can be seen that a quadrature hybrid circuit like that in FIG. 5, comprised of transmission lines 180 and 182 with characteristic impedance $Z_a$ and transmission lines 181 and 183 with characteristic impedance $Z_b$, all four transmission lines being interconnected in a rectangle, is placed in the center of substrate 70, which is roughly square in shape. The design is such that characteristic impedance $Z_a$ of the transmission lines 180 and 182 equals $1/\sqrt{2}$ of $Z_b$, which is the characteristic impedance of the transmission lines 181 and 183, and the coupling factor C is 3 dB. Input/output transmission lines (hereinafter referred to as I/O transmission lines) 71, 72, 73, 74 with characteristic impedance of $Z_0$ extend from the ports 1, 2, 3, 4 towards the edges of the substrate 70 in a direction parallel to the transmission lines 180 and 182. They are used as high frequency signal I/O lines for the ports 1, 2, 3, 4.

Though not shown in the diagram, the entire back surface of the substrate 70 is comprised of a ground pattern that is connected to the ground electrode 77, and the small white circles on the ground electrode 77 are through-holes for connection to the ground pattern. Furthermore, the rather large white circles on the ground electrodes 77 on the four corners of the substrate 70 are screw holes to insert screws to fix substrate 70 to another substrate, or the like.

Returning to FIG. 7, the port 2 (see FIG. 6) of the quadrature hybrid circuit is connected to the pin 5, which is the single pole terminal of the SPDT switch comprising MMIC switch element 52, via a chip capacitor to cut out direct current. The basic connections are the same as in the case of the above-mentioned switch element 50, except that the transmission line 53 is connected to the pin 7 of the MMIC, due to the substrate wiring layout. For this reason, the relationship of logical levels of the control signal applied to the pin 1 and pin 8 of the MMIC in the case that the transmission line 53 is connected to the port 2 is the reverse of that for the switch element 50.

As explained above, the double throw terminal pins 2 and 7 of the SPDT switch are facing each other on opposite sides of the package. Therefore, the transmission line 51 is connected to the pin 2 of the SPDT switch comprising MMIC switch element 50, but in the case of the MMIC switch element 52, the transmission line 53 is connected to the pin 7 rather than the pin 2, as indicated by the dotted line in FIG. 7. A wiring pattern with a layout such as shown in FIG. 6 thus becomes possible. The relationships of the MMIC switch elements 54 and 56 are similar to those of the MMIC switch elements 50 and 52, so their explanation is omitted.

Third Embodiment

Figure 8:
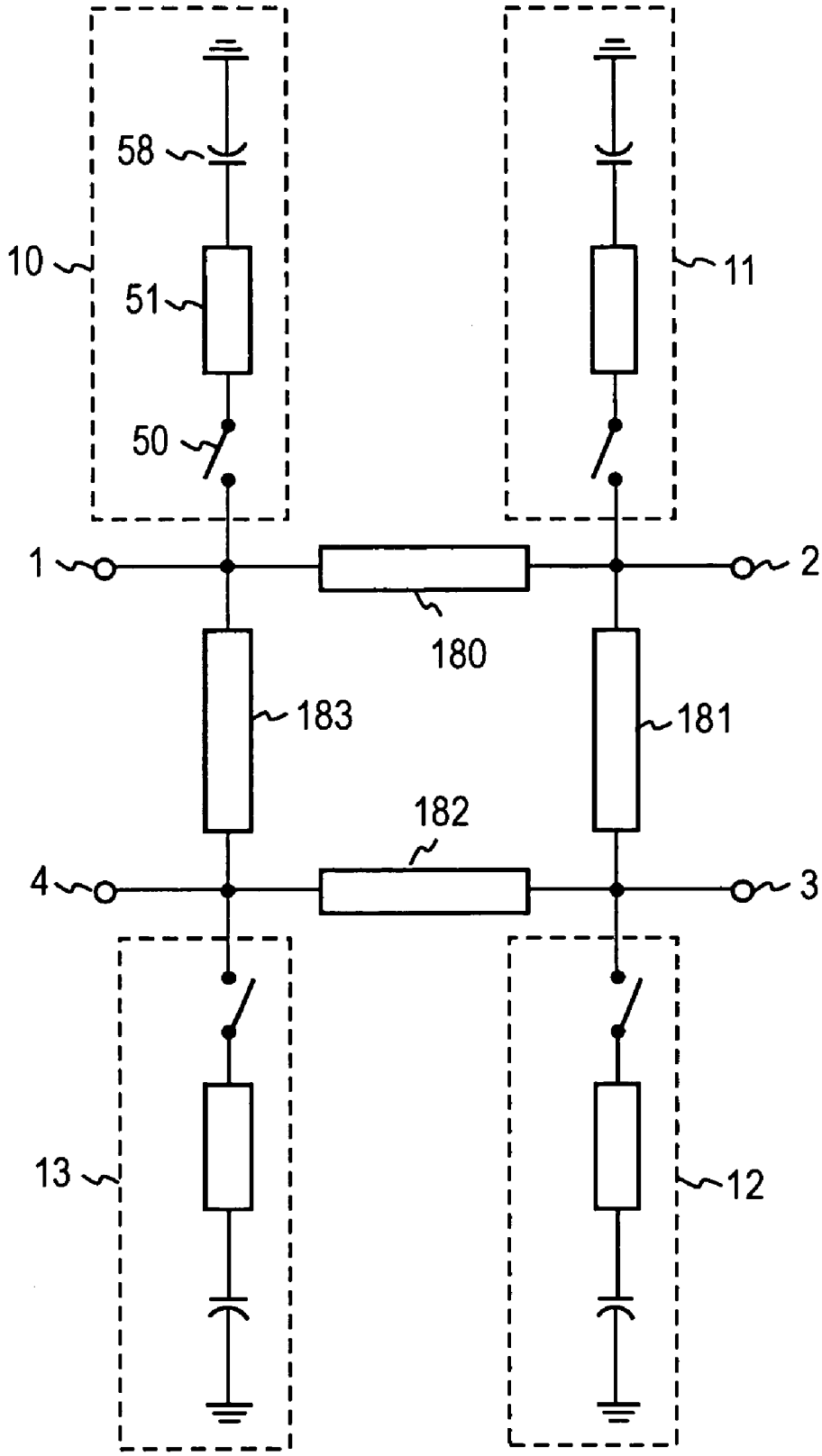
FIG. 8 is a diagram of a third embodiment of the present invention.

In the third embodiment indicated in FIG. 8, the variable reactance means 10 is comprised of a switch element 50, a transmission line 51, and a capacitor element 58, which are connected serially. One end of the switch element 50, which is at one end of the serial connection comprising the variable reactance means 10, is connected to the port 1, and one end of the capacitor element 58, which is at the other end of said serial connection, is grounded.

The variable reactance means 11, 12 and 13, which are connected to the ports 2, 3, 4, are of identical configuration to the variable reactance means 10 described above. The switch elements of the variable reactance means 10, 11, 12 and 13 are controlled so that they are all simultaneously either in a conductive state or in a non-conductive state. In the following explanation, the configuration and operation of the variable reactance means 10 connected to the port 1 is described, but explanations of the variable reactance means 11, 12, 13 are omitted. In figures illustrating subsequent embodiments of the present invention, variable reactance means 11, 12, 13 shall be indicated in abbreviated form as dotted line boxes.

In the present case, the transmission line 51 is a line with an electric length of approximately 60 degrees, as explained in the case of the second embodiment. In the case of the second embodiment, it was explained that the transmission line 51 functions as an open end line, and that the operating frequency changes from 2.0 GHz to 1.5 GHz when such an open end line is connected to each port. However, in FIG. 8, the transmission line 51 functions as a short-circuit end line, due to the fact that the end of this same transmission line 51 is grounded via a capacitor element 58 that has a capacitance value relatively large enough so that impedance is sufficiently low in the operating frequency band.

Figure 9:
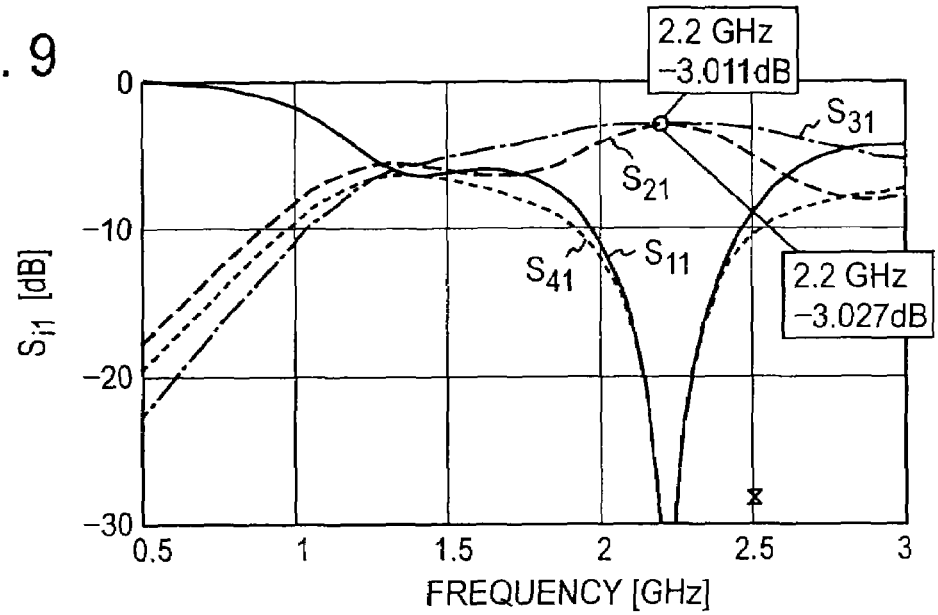
FIG. 9 is a diagram showing the frequency-amplitude characteristics corresponding to FIG. 8.

When such a transmission line 51 that functions as a short-circuit end line is connected to each of the ports 1, 2, 3, 4 by putting switch elements 50 in a conductive state, the operating frequency changes to 2.2 GHz. In this manner, even when a transmission line 51 of the same electric length is used, the direction and amount of change in operating frequency vary greatly depending on whether it is used as an open end line or as a short-circuit end line. The amplitude characteristics in this case are shown in FIG. 9. In FIG. 9, the horizontal axis indicates frequency and the vertical axis indicates transfer characteristics as the S parameter (e.g. $S_{i1}$) in dB when a high frequency signal is input into the port 1. Both $S_{21}$ and $S_{31}$ are approximately −3.0 dB at a frequency of 2.2 GHz, indicating that the operating frequency has changed to 2.2 GHz.

Fourth Embodiment

Figure 10:
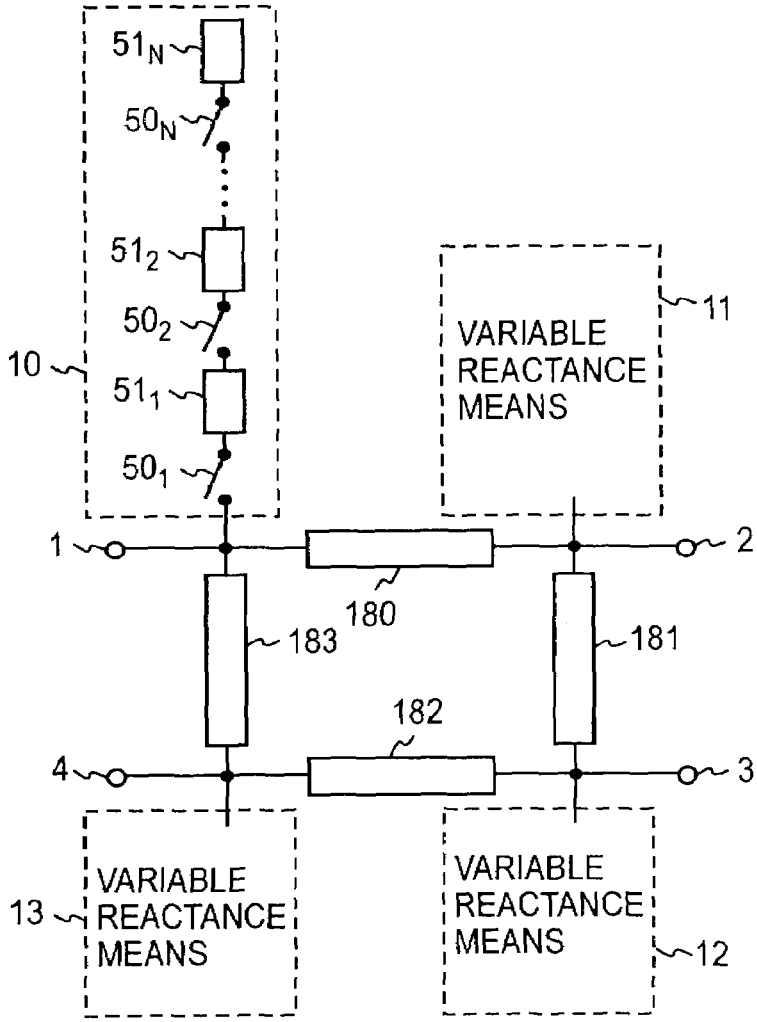
FIG. 10 is a diagram of a fourth embodiment of the present invention.

In the fourth embodiment shown in FIG. 10, the variable reactance means 10 is comprised of switch elements $\mathbf{50}_1$, $\mathbf{50}_2$, . . . , $\mathbf{50}_N$ and reactance elements $\mathbf{51}_1$, $\mathbf{51}_2$, . . . , $\mathbf{51}_N$ alternating with each other in a serial connection. N is an integer of 2 or greater. The same is true for variable reactance means 11, 12 and 13.

The case in which N=2 is explained below. Here it is assumed that each of the variable reactance means 10, 11, 12, 13 is comprised of two transmission lines, such that, for instance, the reactance element $\mathbf{51}_1$, which is the first in the series of reactance elements connected to each of the ports 1, 2, 3, 4, is a transmission line with an electric length of approximately 24 degrees at a frequency of 2 GHz, and the reactance element $\mathbf{51}_2$, which is the second in the series of reactance elements connected to each of the ports 1, 2, 3, 4, is a transmission line with an electric length of approximately 36 degrees at a frequency of 2 GHz.

As explained above, the quadrature hybrid circuit comprised of transmission lines 180, 181, 182, 183 is designed so that its operating frequency is 2 GHz when the switch elements $\mathbf{50}_1$, which are the first of the switch elements connected to each of the ports 1, 2, 3, 4, are in a non-conductive state. In this state, when the switch elements 50, that are nearest to each of the ports 1, 2, 3, 4 are put into a conductive state to connect transmission lines $\mathbf{51}_1$, which have an electric length of approximately 24 degrees at a frequency of 2 GHz, to each of the ports 1, 2, 3, 4, the transmission lines $\mathbf{51}_1$ function as open end lines, so that the operating frequency of the quadrature hybrid circuit changes to 1.8 GHz.

Figure 11:
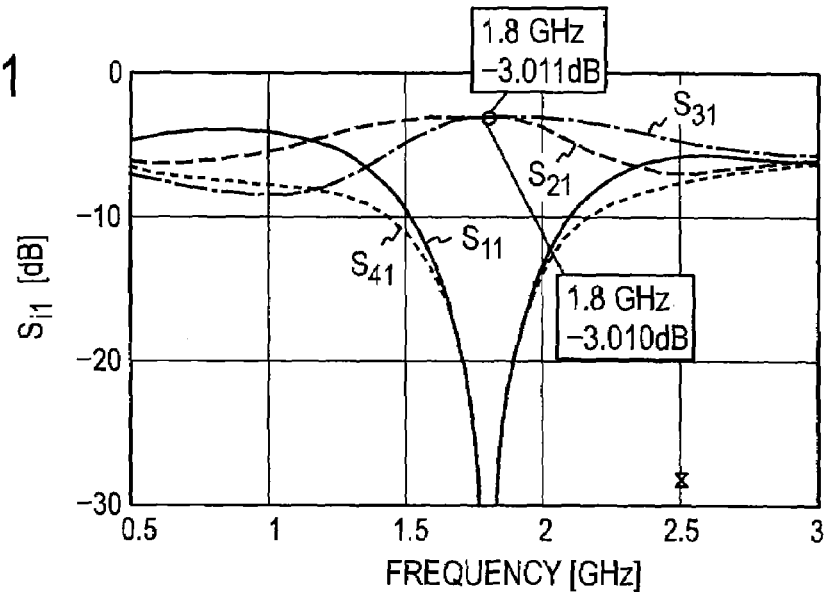
FIG. 11 is a diagram showing the frequency-amplitude characteristics corresponding to FIG. 10.

The amplitude characteristics for different frequencies when transmission lines with an electric length of 24 degrees are connected to each of the ports 1, 2, 3, 4 are shown in FIG. 11. As in the case of FIG. 3A, the horizontal axis indicates frequency in GHz, and the vertical axis indicates the transfer characteristics pertaining to the high frequency signal input into the port 1 as the S parameter (e.g. $S_{i1}$) in dB.

FIG. 11 shows that $S_{21}$ and $S_{31}$ are approximately −3.0 dB at a frequency of 1.8 GHz. $S_{11}$ and $S_{41}$ are both below −30 dB at a frequency of 1.8 GHz, showing that the signal is input to the port 1 with almost no reflection, and that almost none of the signal is transferred to the port 4. It is apparent that the operating frequency of the quadrature hybrid circuit, which was 2 GHz, is changed to 1.8 GHz when an open end line with an electric length of 24 degrees is connected to each of the ports 1, 2, 3, 4 in this manner.

Next, with switch element $\mathbf{50}_1$ in each of the variable reactance means 10, 11, 12, 13 remaining in a conductive state, if each switch element $\mathbf{50}_2$, which is second closest to the ports 1, 2, 3, 4, is put into a conductive state so that the transmission line $\mathbf{51}_2$ with an electric length of approximately 36 degrees is connected to the transmission line $\mathbf{51}_1$ with an electric length of approximately 24 degrees, the total electric length of transmission lines connected to each of the ports 1, 2, 3, 4 becomes 60 degrees. In this state, the operating frequency of the quadrature hybrid circuit becomes 1.5 GHz. This is identical to that of the second embodiment, in which the transmission lines 51, 53, 55 and 57, each with an electric length of approximately 60 degrees by themselves, were connected to each of the ports 1, 2, 3, 4. The frequency characteristics of amplitude and phase in this case are also the same as in FIGS. 4A and 4B.

In this manner, it is possible to lower the operating frequency sequentially by serially connecting multiple transmission lines via switching elements, such that their total electric length is extended.

Fifth Embodiment

Figure 12:
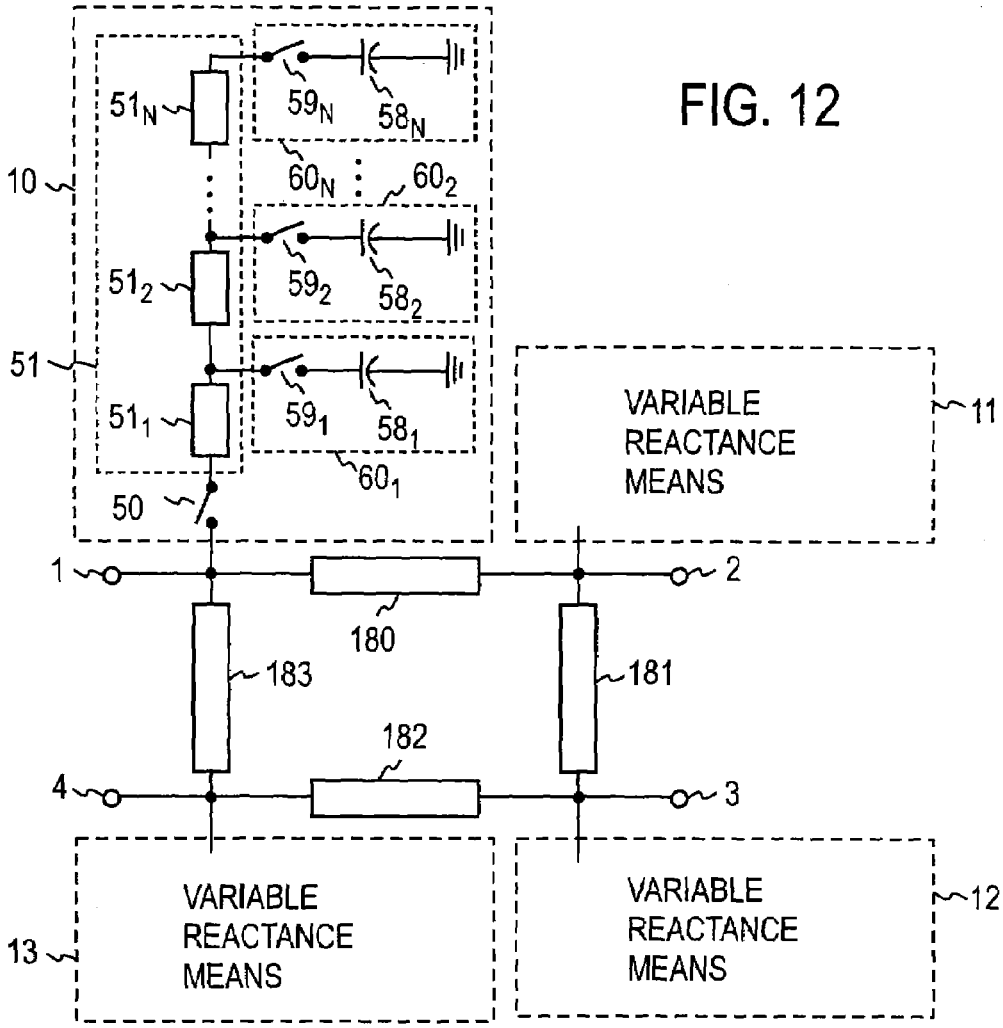
FIG. 12 is a diagram of a fifth embodiment of the present invention.

In the fifth embodiment shown in FIG. 12, the variable reactance means 10 is configured with the transmission line 51, which is comprised of multiple serially connected reactance elements $\mathbf{51}_1$, $\mathbf{51}_2$, . . . , $\mathbf{51}_N$, to each of which is added respective ground switch means $\mathbf{60}_1$, $\mathbf{60}_2$, . . . , $\mathbf{60}_n$ (n=1, 2, . . . , N), which is a serially connected circuit comprising a respective switch element $\mathbf{59}_1$, $\mathbf{59}_2$, . . . , $\mathbf{59}_n$ and a corresponding capacitor element $\mathbf{58}_1$, $\mathbf{58}_2$, . . . , $\mathbf{58}_n$ and is connected between ground and one end of the reactance element $\mathbf{51}_n$ on the side opposite from the switch element 50. The other variable reactance means 11, 12 and 13 also have the same configuration. The switch element 59*n* and the capacitor element $\mathbf{58}_n$ of each ground switch means 60*n* may also be connected in reverse order.

The case in which N=2 is explained below. Specifically, the serially connected part 51 of the variable reactance means 10 connected to the port 1 is comprised of a serial connection of the transmission line $\mathbf{51}_1$ with an electric length of approximately 24 degrees and the transmission line $\mathbf{51}_2$ with an electric length of approximately 36 degrees at a frequency of 2 GHz.

When the switch element 50 is in a conductive state, the electric length of serially connected part 51 at 2 GHz is approximately 60 degrees, such that operation is the same as in the second embodiment (FIG. 5). Therefore, the operating frequency of the quadrature hybrid circuit is 1.5 GHz.

In this state, if the switch element $\mathbf{59}_1$ of the ground switch means $\mathbf{60}_1$ connected to the transmission line $\mathbf{51}_1$ in each of the variable reactance means 10, 11, 12, 13 is put into a conductive state, the end of the transmission line $\mathbf{51}_1$ is grounded via the capacitor 58, such that it operates as a short-circuit end line, due to the fact that the capacitance of capacitor element 58, is such a relatively large value that impedance in this frequency band is negligible.

Figure 13A:
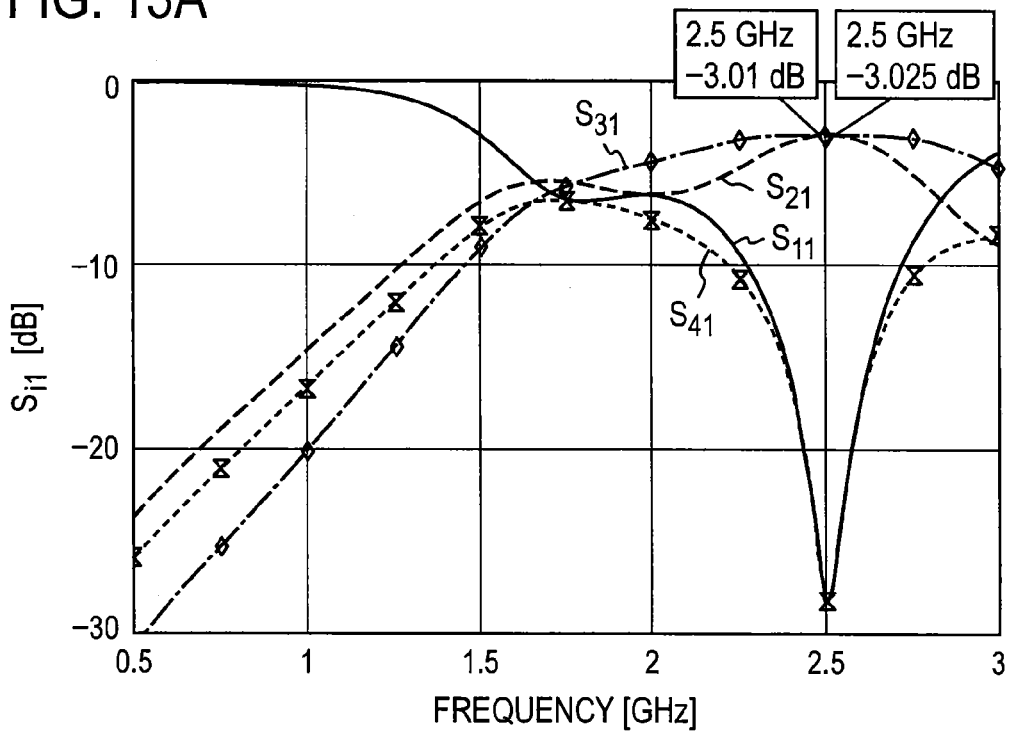
FIG. 13A is a diagram showing the frequency characteristics of amplitude corresponding to FIG. 12.
Figure 13B:
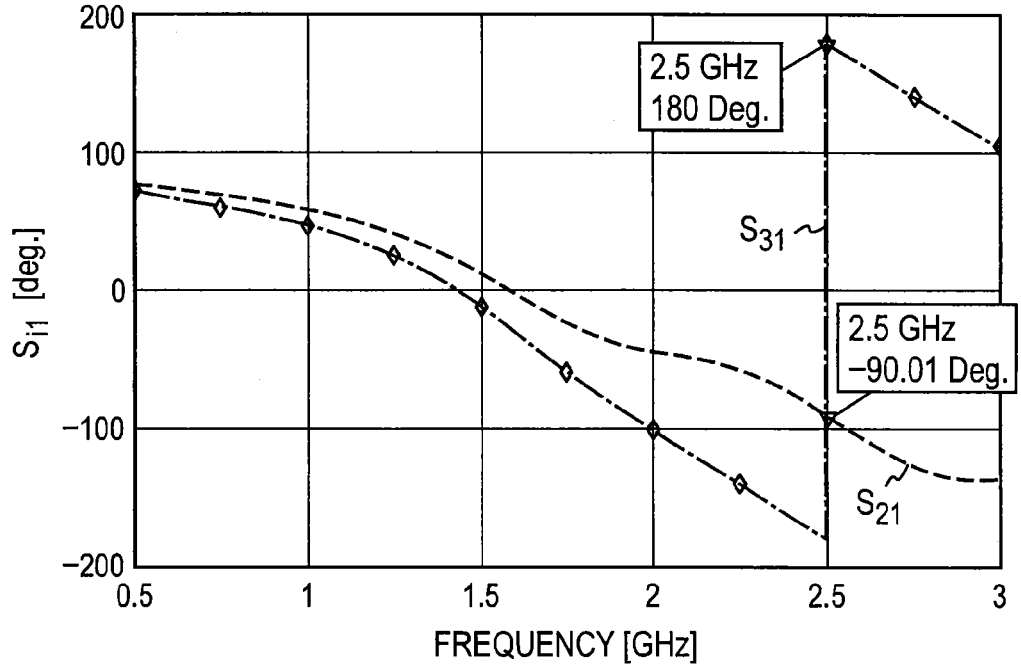
FIG. 13B is a diagram showing the frequency characteristics of phase corresponding to FIG. 12.

The frequency characteristics of amplitude and phase in this case are shown in FIGS. 13A and 13B. The operating frequency, which was previously 1.5 GHz, has now changed to 2.5 GHz. As shown in FIG. 13A, $S_{21}$ and $S_{31}$ are approximately −3.0 dB at a frequency of 2.5 GHz. $S_{11}$ and $S_{41}$ are both approximately −28 dB at a frequency of 2.5 GHz, showing that the signal is input to the port 1 with almost no reflection, and that almost none of the signal is transferred to the port 4. As for the frequency characteristics of phase shown in FIG. 13B, $S_{21}$, which indicates the phase of the signal output from the port 2 in relation to the high frequency signal input into the port 1, is −90 degrees at a frequency of 2.5 GHz, whereas $S_{31}$, which is the phase of the signal output from the port 3, is −180 degrees at the same frequency of 2.5 GHz.

As illustrated above, the operating frequency of a quadrature hybrid circuit can be drastically changed, for instance, from 1.5 GHz to 2.5 GHz, by making each transmission line $\mathbf{51}_1$ operate as a short-circuit end line by means of the ground switch means $\mathbf{60}_1$ closest to each port.

Next, the switch element $\mathbf{59}_1$ of the ground switch means $\mathbf{60}_1$ in each of the variable reactance means 10, 11, 12, 13 that was in a conductive state is put into a non-conductive state, and the switch element $\mathbf{59}_2$ of the ground switch means $\mathbf{60}_2$ connected to the transmission line $\mathbf{51}_2$, which is second in line from each of the ports 1, 2, 3, 4, is put into a conductive state. A line with an electric length of approximately 60 degrees, comprised of the transmission lines $\mathbf{51}_1$ and $\mathbf{51}_2$ serially connected, now operates as a short-circuit end line. The operating frequency in this case becomes 2.2 GHz, and the characteristics are the same as for FIG. 9 explained above. In this manner, by serially connecting multiple reactance elements and by putting into a conductive state just one of the switch elements of the ground switch means that are connected to the reactance elements on the end opposite from ports 1, 2, 3, 4, it is possible to set the frequency determined by serially connecting multiple reactance elements as the lowest frequency, and to obtain multiple other higher operating frequencies.

Sixth Embodiment

Figure 14:
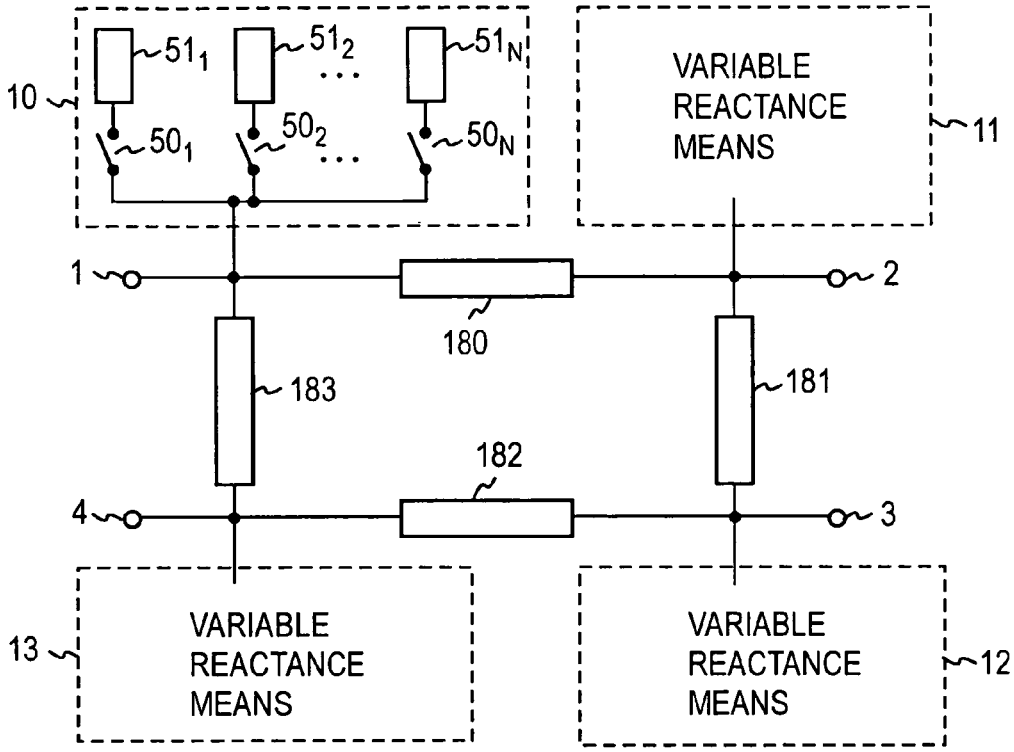
FIG. 14 is a diagram of a sixth embodiment of the present invention.

In the sixth embodiment shown in FIG. 14, each of the variable reactance means 10, 11, 12, 13 that are connected to the ports 1, 2, 3, 4 is comprised of multiple switch elements $\mathbf{50}_1$, $\mathbf{50}_2$ . . . , $\mathbf{50}_N$ that on one side are all connected to the corresponding port, and multiple reactance elements $\mathbf{51}_1$, $\mathbf{51}_2$, . . . , $\mathbf{51}_N$ of different electric lengths, which are connected to the other side of the respective switch elements $\mathbf{50}_1$, $\mathbf{50}_2$, . . . , $\mathbf{50}_N$. N is an integer of 2 or greater.

By selectively putting the switch elements $\mathbf{50}_1$, $\mathbf{50}_2$, . . . , $\mathbf{50}_N$ into a conductive state to vary the reactance values of the connections to the ports, it is possible to make the operating frequency of the quadrature hybrid circuit variable. The operation is obvious from the above, so its explanation is omitted.

Seventh Embodiment

Figure 15:
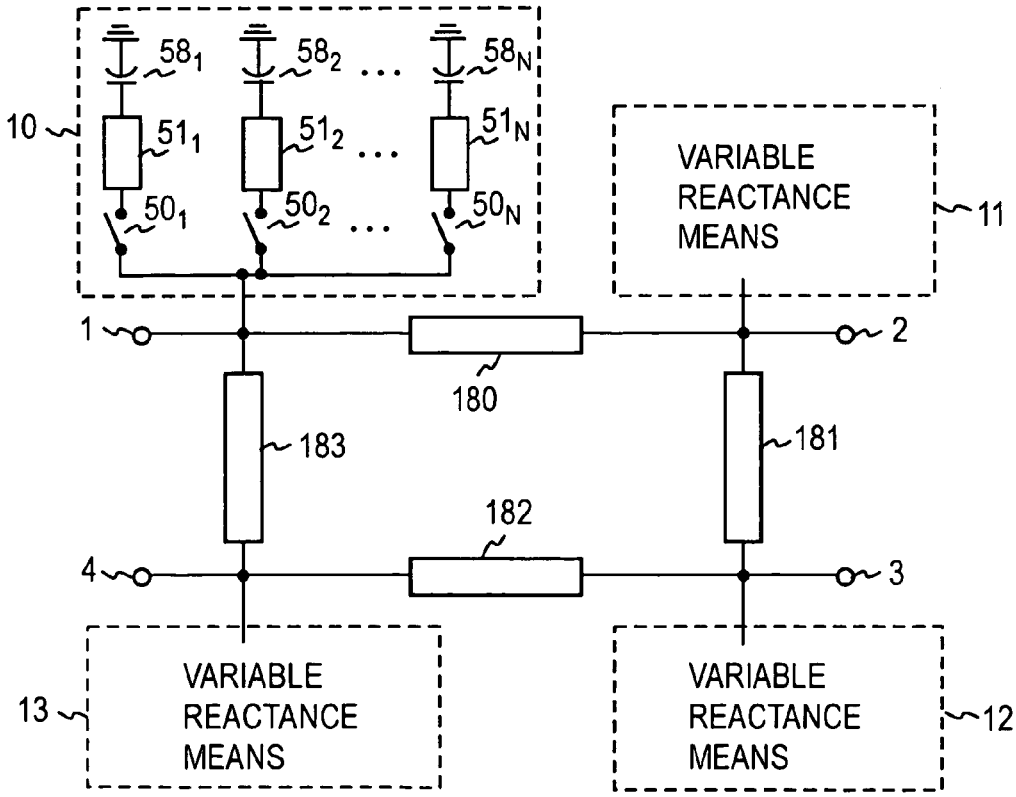
FIG. 15 is a diagram of a seventh embodiment of the present invention.

The seventh embodiment shown in FIG. 15 is configured such that the ends of reactance elements $\mathbf{51}_1$, $\mathbf{51}_2$, . . . , $\mathbf{51}_N$ in each of the variable reactance means 10, 11, 12, 13 in FIG. 14 are grounded via capacitor elements $\mathbf{58}_1$, $\mathbf{58}_2$, . . . , $\mathbf{58}_N$, each with capacitance values such that impedance is sufficiently low in the frequency bands used.

In such a configuration, when the reactance elements $\mathbf{51}_1$, $\mathbf{51}_2$, . . . , $\mathbf{51}_N$ are, for instance, comprised of transmission lines, the reactance elements that operated as open end lines in the sixth embodiment of FIG. 14 now operate as short-circuit end lines in the seventh embodiment of FIG. 15.

By selectively putting one of the switch elements $\mathbf{50}_1$, $\mathbf{50}_2$, . . . , $\mathbf{50}_N$ in a conductive state to vary the reactance value of the connection to each port, it is possible to make the operating frequency of the quadrature hybrid circuit variable. The operation is obvious from the above, so its explanation is omitted.

Eighth Embodiment

Figure 16:
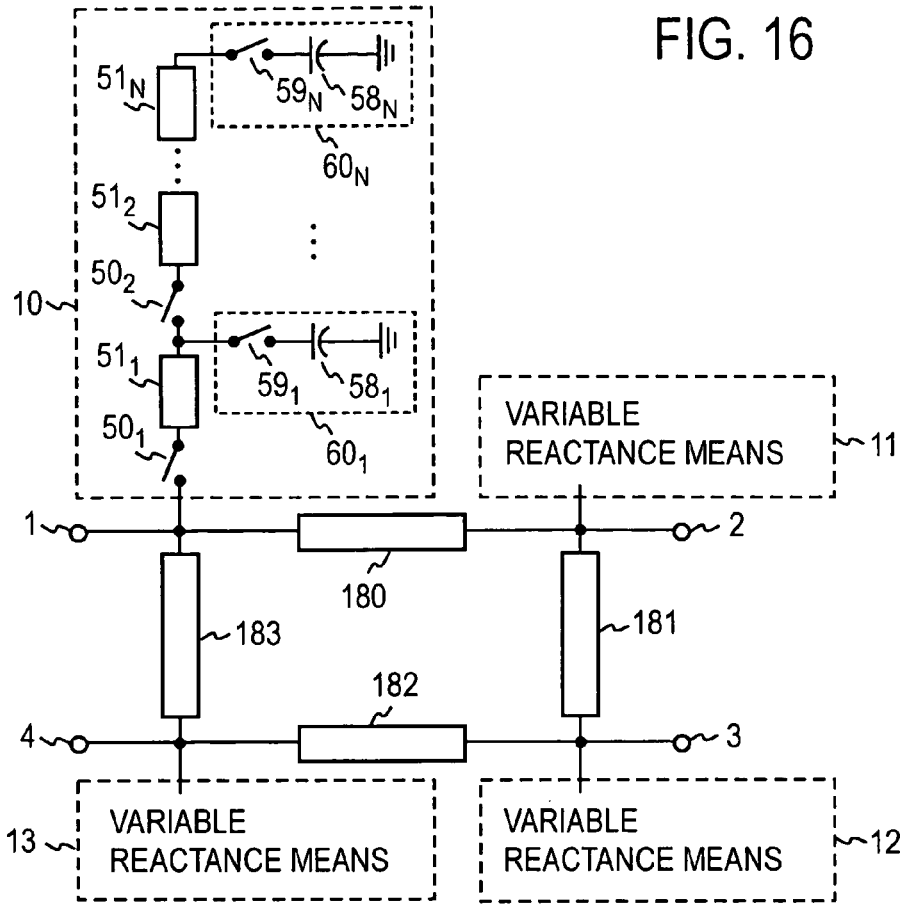
FIG. 16 is a diagram of an eighth embodiment of the present invention.

In the eighth embodiment shown in FIG. 16, the ground switch means $\mathbf{60}_1$, $\mathbf{60}_2$, . . . , $\mathbf{60}_N$ indicated in the embodiment of FIG. 12 are connected to the reactance elements $\mathbf{51}_1$, $\mathbf{51}_2$, . . . , $\mathbf{51}_N$ of FIG. 10 on the opposite side of the corresponding ports, respectively.

Such a configuration makes it possible to increase the number of operating frequencies that can be selected. For instance, in the embodiment of FIG. 12, the reactance element $\mathbf{51}_1$ cannot be open ended, but in the embodiment of FIG. 16, the reactance element $\mathbf{51}_1$ can be made either open ended or end-terminated by use of the switch elements $\mathbf{50}_2$ and $\mathbf{59}_1$. The operation is obvious from the above, so its explanation is omitted.

Ninth Embodiment

Depending upon the reactance value of the variable reactance means 10, 11, 12, 13 connected respectively to the ports 1, 2, 3, 4, there are cases in which the desired frequency characteristics are not achieved because matching conditions are lost due to large changes in impedance seen from the input and output sides of the quadrature hybrid circuit. Therefore, a matching circuit is needed to transmit the signal efficiently. Since said impedance varies according to frequency, a matching circuit that can achieve matching conditions at multiple frequencies is required.

Figure 17:
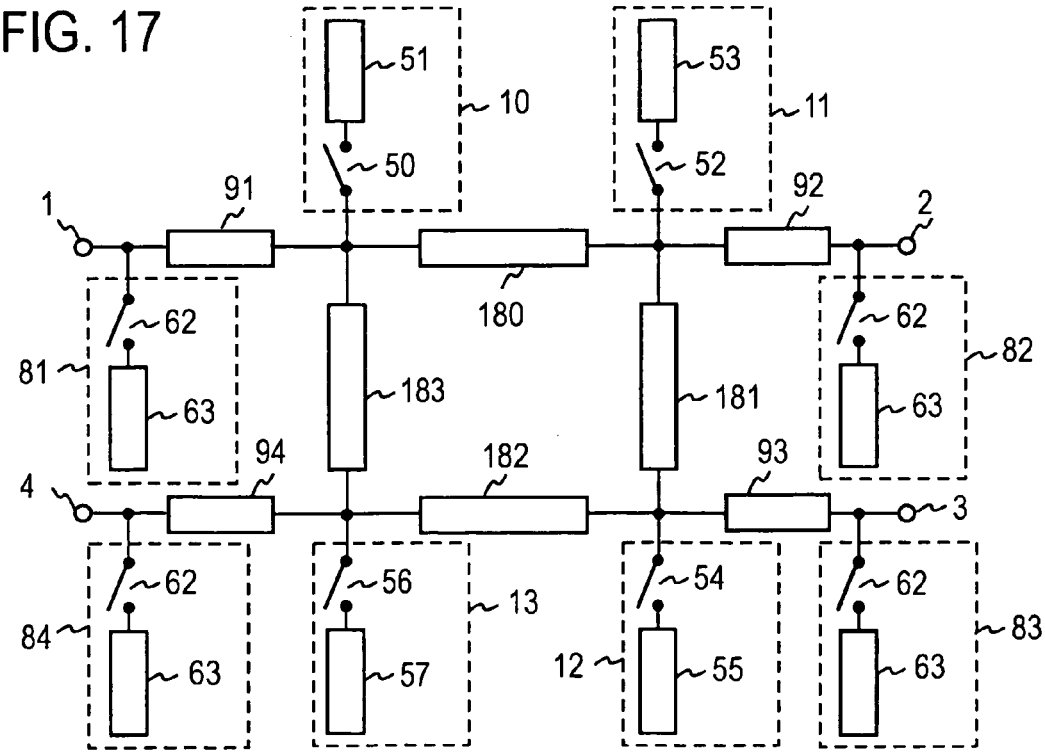
FIG. 17 is a diagram of a ninth embodiment of the present invention.

Therefore, in the ninth embodiment shown in FIG. 17, in order to maintain matching conditions even when the operating frequency of the quadrature hybrid circuit is changed by varying the reactance value of the variable reactance means 10, 11, 12, 13, impedance matching transmission lines whose one ends are connected to the respective junction points of the ring-connected four transmission lines 180, 181, 182, 183 and whose other ends serve as the four ports for the quadrature hybrid circuit, are established such that the impedance of said impedance matching transmission lines is equal to $Z_0$, and furthermore, impedance matching variable reactance means are connected to the ports such that matching conditions can be maintained even when the operating frequency is changed.

The quadrature hybrid circuit of the embodiment shown in FIG. 17 has impedance matching transmission lines 91, 92, 93, 94 connected on one ends to the junction points of the ring-connected four transmission lines 180, 181, 182, 183, respectively, in the embodiment of FIG. 5, the other ends of the impedance matching transmission lines serving as the four ports 1, 2, 3, 4. The quadrature hybrid circuit further has impedance matching variable reactance means 81, 82, 83, 84 connected to the four ports 1, 2, 3, 4. Each of the impedance matching transmission lines 91, 92, 93, 94 has characteristic impedance $Z_0$ that is equal to the impedance seen looking into the quadrature hybrid circuit from each of the ports 1, 2, 3, 4 (hereinafter referred to as port impedance). The impedance matching variable reactance means 81, 82, 83, 84 are each comprised of a switch element 62 whose one end is connected to one of the ports 1, 2, 3, 4, and a reactance element 63 that is connected to the other end of said switch element 62.

The variable reactance means 10, 11, 12, 13, which are comprised of switch elements 50, 52, 54 and 56 and transmission lines 51, 53, 55 and 57 each with an electric length of approximately 135 degrees at a frequency of 2 GHz, are connected to the junction points of the transmission lines 180 through 183.

When all the switch elements 50, 52, 54 and 56 of the variable reactance means 10, 11, 12, 13 are in a non-conductive state, the operating frequency is 2 GHz. In this case, the switch elements 62 of each of the impedance matching variable reactance means 81, 82, 83, 84 are also in a non-conductive state, and the characteristic impedance of the impedance matching transmission lines 91, 92, 93, 94 connected to the ports 1, 2, 3, 4 is equal to the port impedance, such that a matching condition is achieved.

Next, in order to change the operating frequency to 1.0 GHz, the switch elements 50, 52, 54 and 56 of the variable reactance means 10, 11, 12, 13 are put into a conductive state so that transmission lines 51, 53, 55 and 57, which each have an electric length of approximately 135 degrees, are connected to the junction points of the transmission lines 180, 181, 182, 183, respectively. In this case, if the switch elements 62 of all the impedance matching variable reactance means 81, 82, 83, 84 are left in a non-conductive state, the frequency characteristics of amplitude at the respective ports 1, 2, 3, 4 are as shown in FIG. 18A.

Figure 18A:
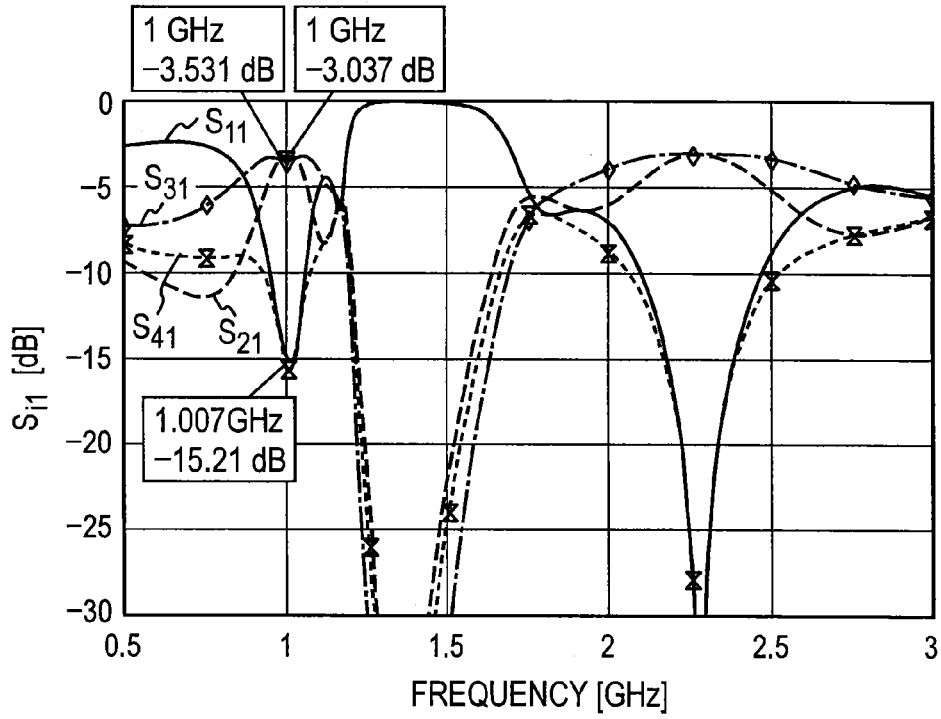
FIG. 18A is a diagram showing the frequency characteristics of amplitude corresponding to FIG. 17, in the case that variable reactance means 81 through 84 for impedance matching are not connected.

As shown in FIG. 18A, $S_{21}$, which indicates the ratio of the signal transferred to the port 2 to the signal input to the port 1 exhibits a value of approximately −3.5 dB at 1.0 GHz, which differs from the desired −3.0 dB. Furthermore, $S_{11}$, which indicates reflection, and $S_{41}$, which indicates the ratio of the signal transferred to the port 4 to the signal input to the port 1, both exhibit a value of approximately −15 dB (approximately 3%) at approximately 1 GHz, which is about 30 times worse than in examples explained thus far, such that use as a quadrature hybrid circuit is not possible. The reason is that by making the switch elements 50, 52, 54 and 56 in a conductive state, transmission lines 51, 53, 55 and 57 with an electric length of approximately 135 degrees are connected to the respective ports 1, 2, 3, 4, causing a major change in the reactance of the variable reactance means 10, 11, 12, 13 such that impedance mismatching occurs.

Incidentally, in FIG. 18A, $S_{21}$ and $S_{31}$ are approximately −3 dB, and $S_{11}$, which represents reflection, as well as $S_{41}$ exhibit a low value of less than −30 dB at a frequency of approximately 2.3 GHz. Such values merely happen to be exhibited due to the periodicity of the transmission lines comprising the variable reactance means 10, 11, 12, 13, and are not the result of mistaken design, so they shall be ignored as irrelevant.

In this manner, when a relatively large change in reactance is caused by the variable reactance means 10, 11, 12, 13 with the intent of achieving an operating frequency of, for instance, 1.0 GHZ, the matching conditions may be lost such that satisfactory characteristics are not achieved. This mismatched state is indicated in the Smith chart of FIG. 18B. As is well known, a Smith chart plots the relationship between impedance and the reflectance coefficient, and can be used to easily identify a circuit's impedance matching state. The horizontal axis passing through the center of the Smith chart shows the real part of the impedance value. When matching conditions exist, the impedance value for the frequency used by the circuit overlaps with the point marked 1.0 on the horizontal axis. The point marked 1.0 indicates normalized impedance, such that the characteristic impedance at the point marked 1.0 would be 50Ω if the port impedance is 50Ω.

Figure 18B:
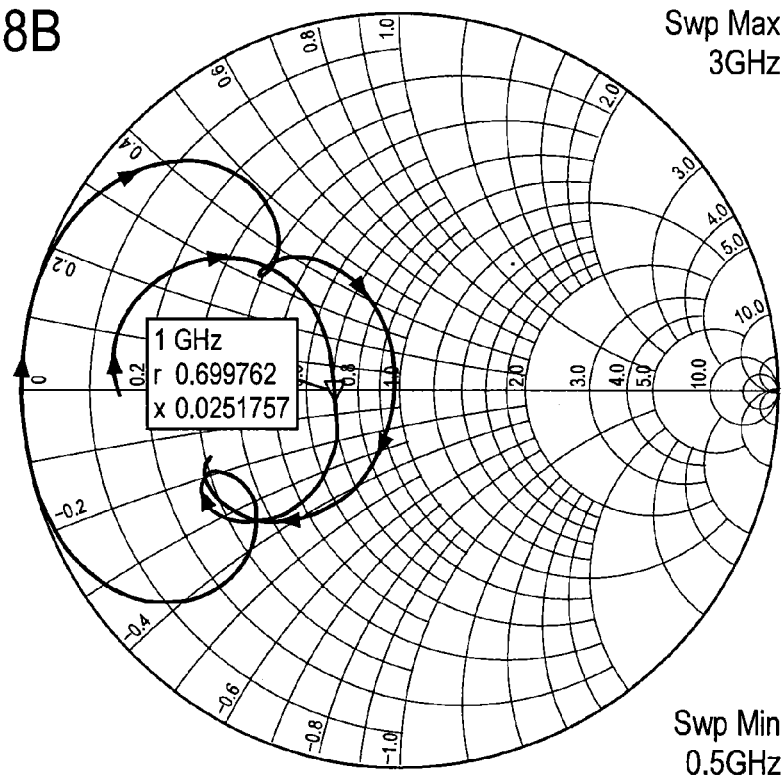
FIG. 18B is a Smith chart showing the frequency characteristics of impedance in the above case.

FIG. 18B plots impedance seen looking into the quadrature hybrid circuit from the port lover the frequencies 0.5 GHz through 3.0 GHz when only the switch elements 50, 52, 54 and 56 of the aforementioned variable reactance means 10, 11, 12, 13 are in a conductive state. At a frequency of 0.5 GHZ, the impedance is close to 0.15 of the real part, after which the plot rotates clockwise as frequency increases passing a point where reflection coefficient x is 0.025 and impedance r is 0.7 in the real part at a frequency of 1.0 GHZ, which is off from the desired value. It is apparent that there is an impedance mismatch as the plot is 0.3 away from the point 1.0 corresponding to a matching state.

Next, switches 62, which are connected to the ports 1, 2, 3, 4 are put into a conductive state, such that the transmission lines 63 with an electric length of 39 degrees are connected. The Smith chart corresponding to FIG. 18B in this state is shown in FIG. 19B. At a frequency of 0.5 GHz, the impedance exhibits a value of approximately 0.18+j 0.35, after which the plot rotates clockwise as frequency increases until it overlaps with the point r=1.0 and x=1.26 at 1.0 GHz. This means that, at a frequency of 1.0 GHz, the impedance seen looking into the quadrature hybrid circuit from each of the ports 1, 2, 3, 4 matches the port impedance of 50Ω. In this manner, it is possible to achieve matching conditions by connecting reactance elements to each of the ports 1, 2, 3, 4. That is, a set of impedance matching transmission line and impedance matching variable reactance means connected to each port constitutes a variable frequency matching circuit.

Figure 19A:
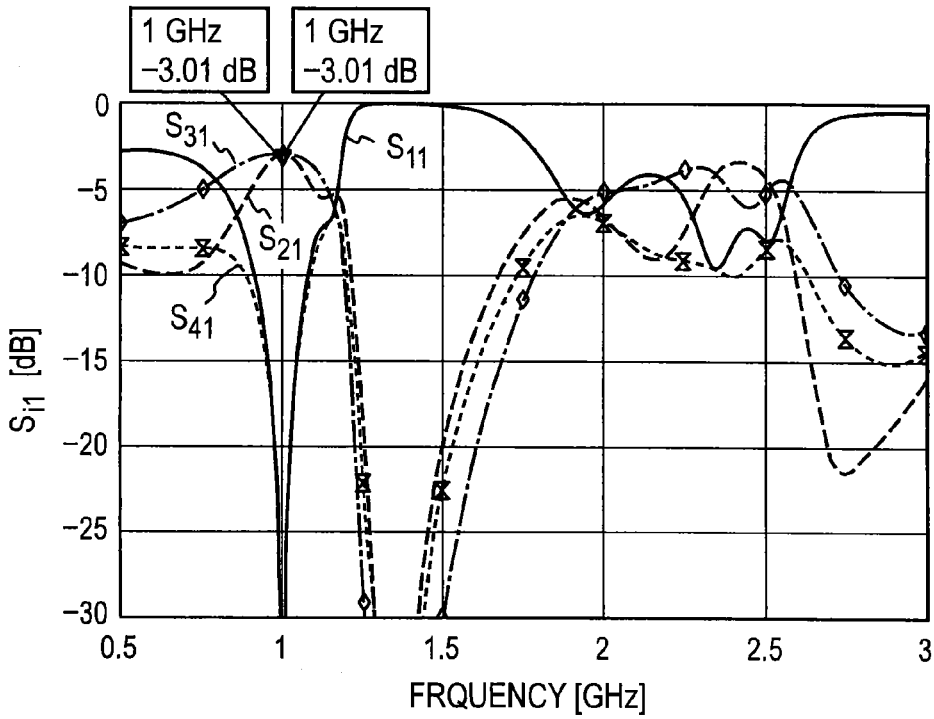
FIG. 19A is a diagram showing the frequency characteristics of amplitude corresponding to FIG. 17, in the case that variable reactance means 81 through 84 for impedance matching are connected.
Figure 19B:
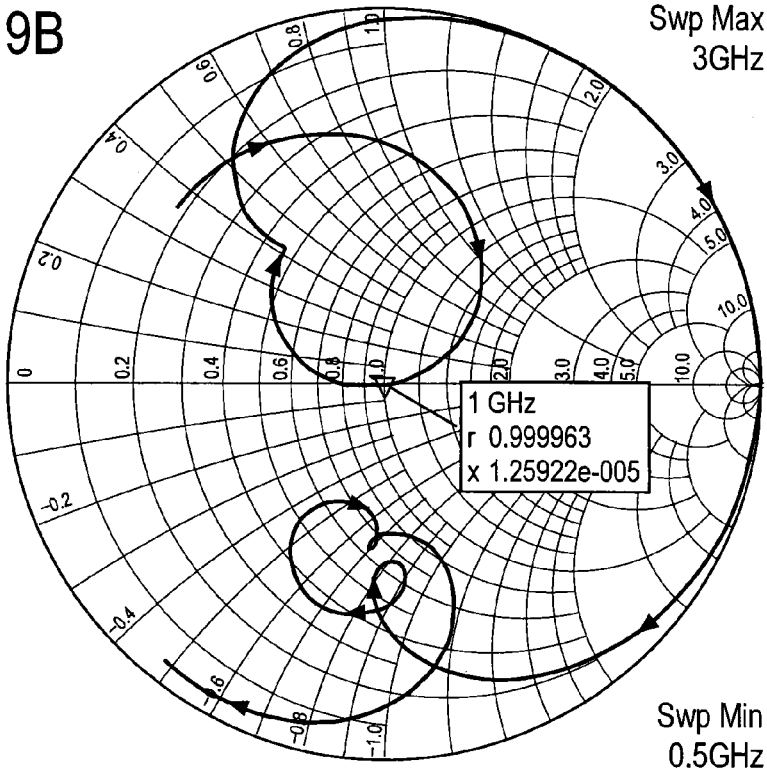
FIG. 19B is a Smith chart showing the frequency characteristics of impedance in the above case.

The frequency characteristics of amplitude for the respective ports 1, 2, 3, 4 in this case are shown in FIG. 19A. $S_{21}$, which indicates the ratio of the signal transferred to the port 2 to the signal input to the port 1, as well as $S_{31}$, which indicates the ratio of the signal transferred to the port 3 to the signal input to the port 1, both exhibit a value of approximately −3.0 dB at 1.0 GHz, whereas $S_{11}$, which indicates reflectance, and $S_{41}$, which indicates the ratio of the signal that is transferred to the port 4 to the signal input to the port 1, both exhibit a value of less than −30 dB. Thus, characteristics enabling use as a quadrature hybrid circuit have been achieved. Furthermore, the large decline in reflectance ($S_{11}$) at a frequency of around 2.3 GHz in FIG. 18A has disappeared in FIG. 19A, showing such a characteristic which is effective only at an operating frequency of 1 GHz.

In this manner, it is possible to prevent loss of matching conditions when the reactance value of the variable reactance means 10, 11, 12, 13 is increased to a large value, by connecting impedance matching transmission lines 91, 92, 93, 94 with characteristic impedance equal to the port impedance of the quadrature hybrid circuit to the respective ports of the quadrature hybrid circuit, and by connecting impedance matching variable reactance means 81, 82, 83, 84 to the ports 1, 2, 3, 4.

Furthermore, though FIG. 17 was used to explain an example in which each of the variable reactance means 10, 11, 12, 13 could take only one reactance value, and each of the impedance matching variable reactance means 81, 82, 83, 84 also could take only one reactance value, it is also possible to make multiple reactance values selectable.

Furthermore, though the embodiment shown in FIG. 17 has a basic configuration such that variable frequency matching circuits (71-74, 81-84) are added to the ports 1, 2, 3, 4 of the quadrature hybrid circuit explained with embodiment 2 (FIG. 5), it is also applicable to any of the other embodiments explained thus far.

Tenth Embodiment

So far, the present invention has been explained using a configuration in which variable reactance means are connected to the respective ports of a quadrature hybrid circuit comprising transmission lines 180 through 183 connected in a ring. However, any one or more of the four transmission lines connected in a ring may be substituted with a two-port lumped element circuit comprised of lumped elements.

The transmission line may be substituted with a two-port π type circuit comprised of lumped elements whose admittance values conform to the relationships shown in equations (1) and (2). Such an embodiment is shown in FIG. 20.

Figure 20:
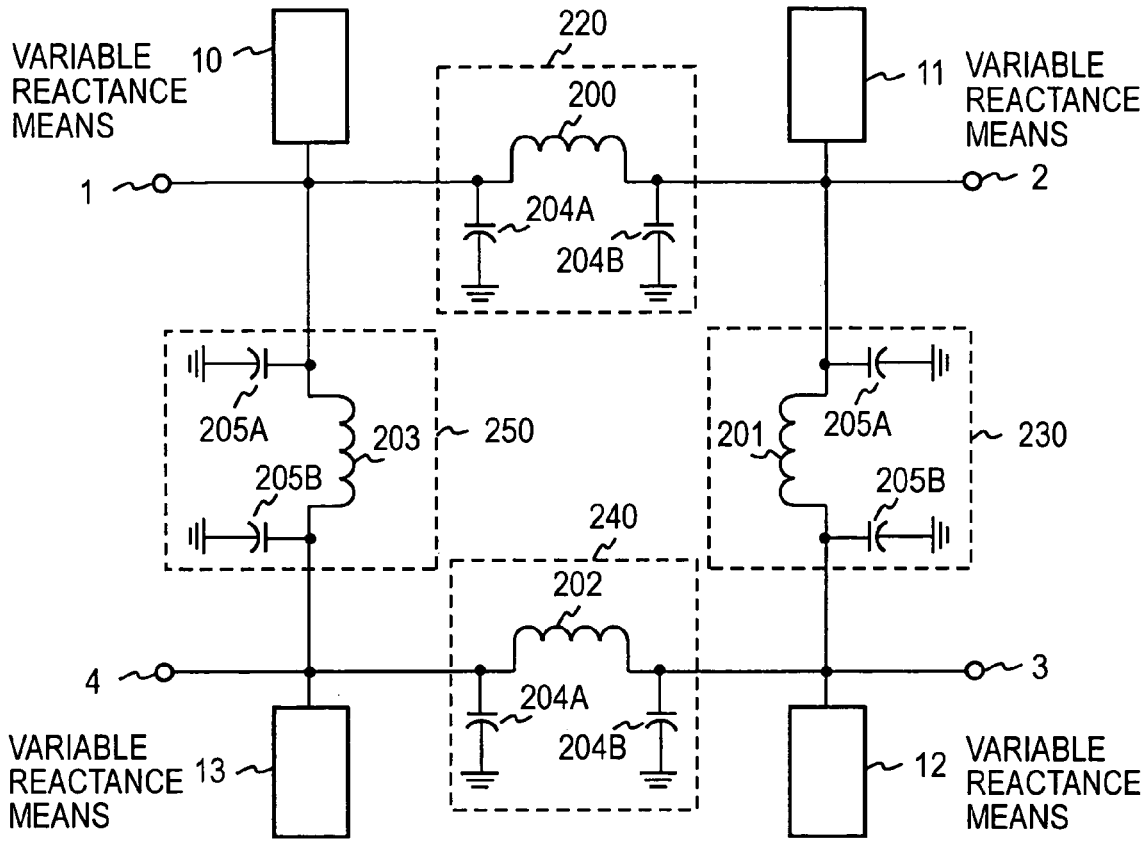
FIG. 20 is a diagram of a tenth embodiment of the present invention, wherein transmission lines are substituted with lumped elements.

FIG. 20 illustrates the tenth embodiment wherein each of the four transmission lines has been replaced with a π type circuit. Four inductors 200, 201, 202 and 203 constituting part of the π type circuits 220, 230, 240 and 250 are connected in a ring, capacitors 204A and 204B with equal capacitance and with one side grounded are connected on both sides of each of the inductors 200 and 202 and capacitors 205A and 205B with equal capacitance and with one side grounded are connected on both sides of each of the inductors 201 and 203. Specifically, the π type circuit 220 comprising the inductor 200 and the capacitors 204A and 204B corresponds to the transmission line 180, the π type circuit 230 comprising the inductor 201 and the capacitors 205A and 205B corresponds to the transmission line 181, and the π type circuits 240 and 250 containing the inductors 202 and 203, respectively, correspond to the transmission lines 182 and 183, respectively.

In this tenth embodiment as well, the variable reactance means 10, 11, 12, 13 are connected to the junction points between π type circuits 220, 230, 240, 250, respectively, which are connected in a ring. Any of the various types of variant reactance means explained so far may be used as said variable reactance means 10, 11, 12, 13.

As explained, for instance, in the case of FIG. 5, since the characteristic impedance $Z_a$ of the transmission line 180 is set as $1/\sqrt{2}$ of the characteristic impedance $Z_b$ of the transmission line 181 in order to set the coupling factor C as −3 dB, in the case of FIG. 20 as well, the inductance value of the inductor 200 merely needs to be set as $1/\sqrt{2}$ of the inductance value $Z_b/\omega$ of the inductor 201. Likewise, the capacitance value of the capacitors 204A and 204B merely needs to be set as $1/\sqrt{2}$ of the capacitance value $1/(Z_b\omega)$ of the capacitors 205A and 205B, to achieve equivalence with a transmission line with an electric length of approximately one fourth. Meanwhile, the reference marks for the inductors have been changed for ease of explanation, but as apparent from the explanations so far, the inductors 200 and 202 have equal inductance, and the inductors 201 and 203 have equal inductance.

Eleventh Embodiment

Figure 21:
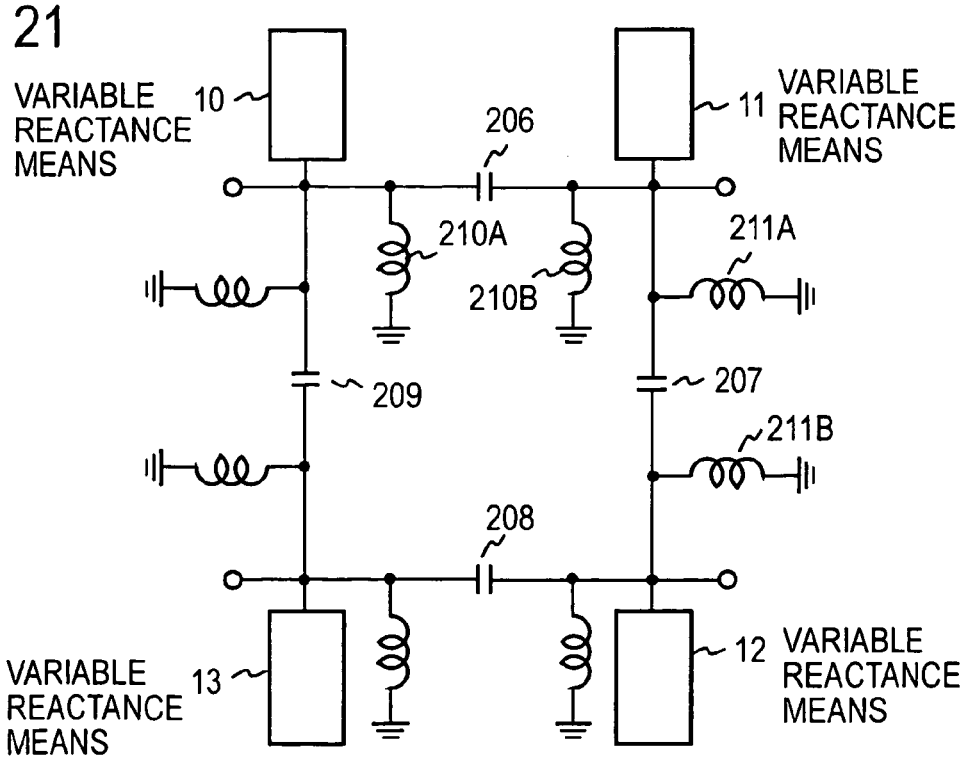
FIG. 21 is a diagram of an eleventh embodiment of the present invention, wherein transmission lines are substituted with lumped elements.

FIG. 21 shows another embodiment of a quadrature hybrid circuit comprised of lumped element circuits. In FIG. 21, four capacitors 206, 207, 208, 209 are connected in a ring, and inductors 210A and 210B with mutually equal inductance and with one end grounded are connected on both sides of each of the capacitors 206 and 208, while inductors 211A and 211B with mutually equal inductance and with one end grounded are connected on both sides of each of the capacitors 207 and 209. In this manner, the π type circuits of FIG. 20 can be replaced with π type circuits in which the layout of inductors and capacitors is reversed.

In brief, as long as the admittance relationships are in accordance with equations (1) and (2), the present invention can be applied to a quadrature hybrid circuit comprised of lumped element circuits to achieve a quadrature hybrid circuit that is operable in multiple frequency bands.

In the embodiments of FIGS. 20 and 21, any one, two, three, or preferably mutually facing pair of lumped element circuits amongst the four lumped element circuits connected in a ring may be replaced with transmission line(s).

Each of the four transmission lines 180, 181, 182, 183 constituting a quadrature hybrid circuit in each of the aforementioned embodiments is a two-port circuit, and each of the lumped element circuits constituting a quadrature hybrid circuit is also a two-port circuit. Thus, the quadrature hybrid circuit can be said to be comprised of four two-port circuits connected in a ring, with their four junction points defining the four ports 1, 2, 3, 4. Therefore, any one or more of the four two-port circuits constituting the quadrature hybrid circuit according to the present invention may be comprised of transmission line(s) or lumped element circuit(s).

Embodiment Twelve

In the embodiment described with reference to FIG. 17, a variable frequency matching circuit comprised of an impedance matching variable reactance means and an I/O transmission line with characteristic impedance equal to port impedance is connected to each of the ports 1, 2, 3, 4 of a quadrature hybrid circuit. Each of such variable frequency matching circuits may also be comprised of lumped elements such as mentioned above.

Figure 22:
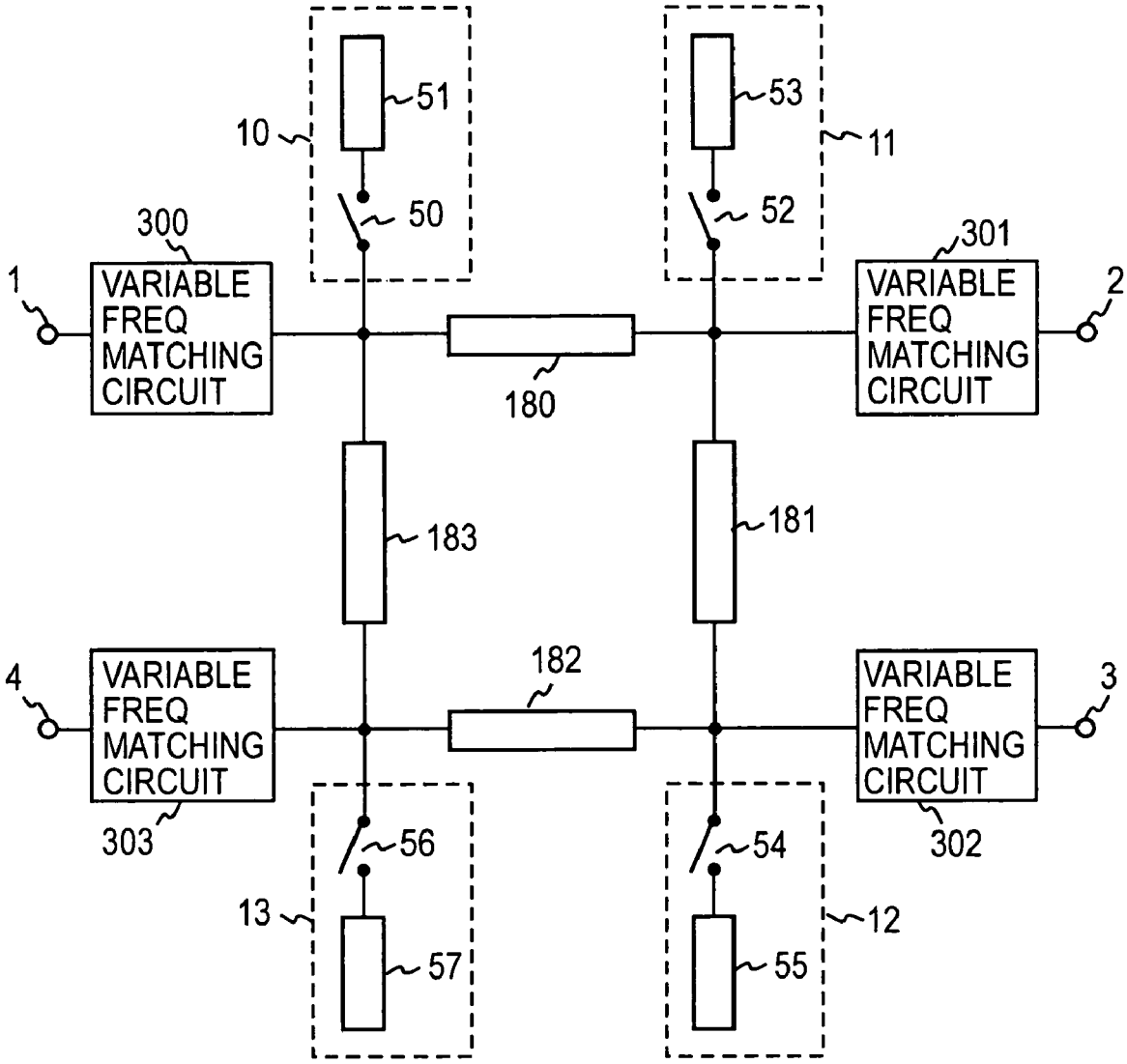
FIG. 22 is a diagram of a twelfth embodiment of the present invention.
Figure 23:
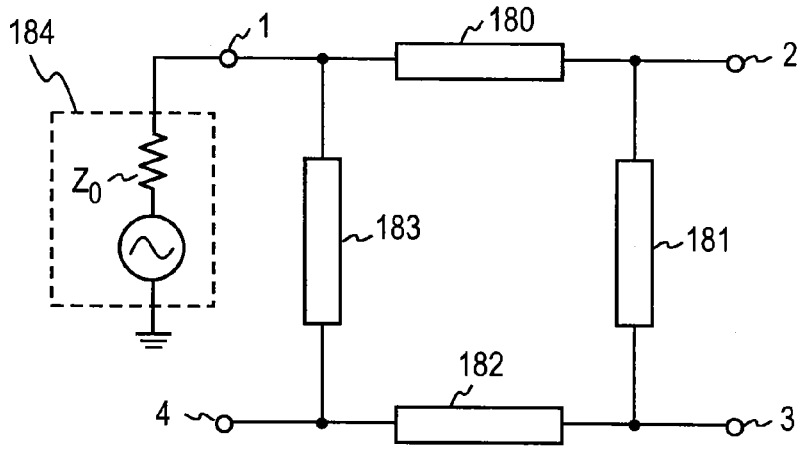
FIG. 23 PRIOR ART
FIG. 23 is a diagram of a conventional branch-line type quadrature hybrid circuit.
Figure 24:
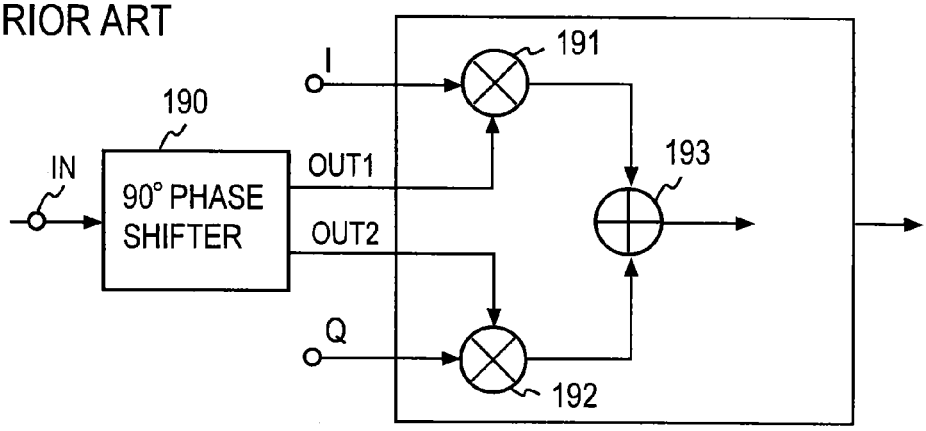
FIG. 24 PRIOR ART
FIG. 24 is a diagram of a conventional quadrature modulator described in patent document 1.
Figure 25:
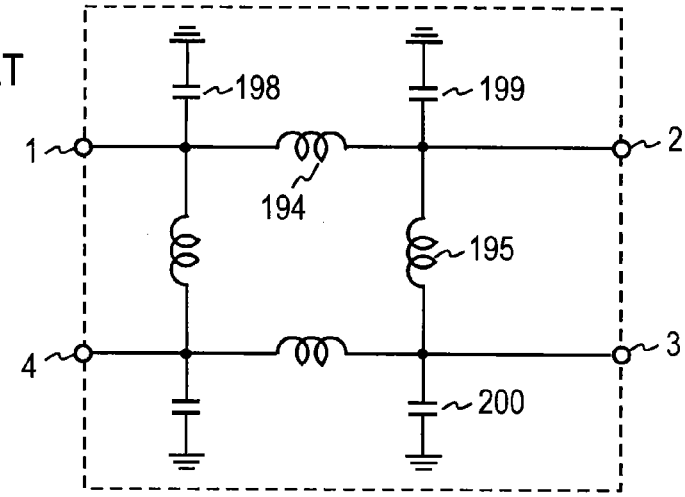
FIG. 25 PRIOR ART
FIG. 25 is a diagram of the quadrature hybrid circuit comprised of lumped elements that is used in the conventional quadrature modulator of FIG. 24.

FIG. 22 shows an embodiment wherein a variable frequency matching circuit comprised, for instance, of lumped elements, is connected to each of the ports 1, 2, 3, 4 of a quadrature hybrid circuit. One end of the variable frequency matching circuits 300, 301, 302, 303 is connected to each of the junction points of the transmission lines 180, 181, 182, 183, and the other end of the variable frequency matching circuits 300, 301, 302, 303 serve as the ports 1, 2, 3, 4 of the quadrature hybrid circuit.

The variable frequency matching circuits 300, 301, 302, 303 connected to the ports 1, 2, 3, 4 are designed such that the characteristic impedance values of the variable frequency matching circuits 300, 301, 302, 303 can be changed to satisfy the matching condition by accommodating for changes in the port impedance caused when the reactance value of the variable reactance means 10, 11, 12, 13 is changed to vary the operating frequency of the quadrature hybrid circuit. Thus is achieved a quadrature hybrid circuit that operates efficiently even when the operating frequency is changed.

As explained above, by means of the quadrature hybrid circuit of the present invention, the part of the circuit consisting of four circuits comprising transmission lines or multiple lumped reactance elements, linked in a rectangular shape, which requires a large circuit area, can be commonly used for multiple frequency bands. Therefore, it is possible to provide a quadrature hybrid circuit that conserves more surface area the more operating frequencies there are.

What is claimed is:

1. A quadrature hybrid circuit, comprising:

four two-port circuits interconnected in a ring, four junction points of said four two-port circuits, said four two-port circuits being configured so that a high frequency signal input to one of the four junction points is output from two of the other junction points at an equal level with a mutual phase difference of 90 degrees, four variable reactance means connected to said four junction points, respectively, for varying an operating frequency of the quadrature hybrid circuit, and four variable frequency matching circuits, each of said four variable frequency matching circuits being capable of impedance matching at multiple frequencies, and connected on one end to corresponding ones of the junction points of said four two-port circuits, the other end of each of said variable frequency matching circuits serving as one of four ports for said high frequency signal.

2. The quadrature hybrid circuit of claim 1, wherein each of said four variable frequency matching circuits comprises: a respective impedance matching transmission line, one end of said impedance matching transmission line is connected to corresponding one of the junction points of said four two-port circuits, and the other end of said impedance matching transmission line serves as one of said four ports for said high frequency signal, said respective impedance matching transmission line having a characteristic impedance equal to the port impedance of said quadrature hybrid circuit, and an impedance matching variable reactance means connected to said other end of said impedance matching transmission line.

3. The quadrature hybrid circuit of claim 1 or 2, wherein each of said four variable reactance means includes a respective variable capacitance element.

4. A quadrature hybrid circuit, comprising:

four two-port circuits interconnected in a ring, four junction points of said four two-port circuits defining four ports, said four two-port circuits being configured so that a high frequency signal input to one of the four ports is output from two of the other ports at an equal level with a mutual phase difference of 90 degrees, and four variable reactance means connected to said four ports, respectively, for varying an operating frequency of the quadrature hybrid circuit, wherein each of said four variable reactance means includes a respective switch element that is connected on one end to a corresponding one of said four port, a respective reactance element connected on one end to the other end of said corresponding switch element, and a respective capacitance element that selectively grounds the other end of said corresponding reactance element.

5. A quadrature hybrid circuit, comprising:

four two-port circuits interconnected in a ring, four junction points of said four two-port circuits defining four ports, said four two-port circuits being configured so that a high frequency signal input to one of the four ports is output from two of the other ports at an equal level with a mutual phase difference of 90 degrees, and four variable reactance means connected to said four ports, respectively, for varying an operating frequency of the quadrature hybrid circuit, wherein each of said four variable reactance means includes a respective serially connected circuit comprised of corresponding multiple switch elements and corresponding multiple reactance elements alternating with each other in a serial connection.

6. The quadrature hybrid circuit of claim 5, wherein each of said four variable reactance means further includes multiple ground switch means, each ground switch means connected between ground and each said reactance element on the side opposite from corresponding one of said four ports, for grounding the high frequency signal.

7. A quadrature hybrid circuit, comprising:

four two-port circuits interconnected in a ring, four junction points of said four two-port circuits defining four ports, said four two-port circuits being configured so that a high frequency signal input to one of the four ports is output from two of the other ports at an equal level with a mutual phase difference of 90 degrees, and four variable reactance means connected to said four ports, respectively, for varying an operating frequency of the quadrature hybrid circuit, wherein each of said four variable reactance means includes multiple switch elements connected at one end thereof to corresponding one of said four ports, and multiple reactance elements connected to the other end of respective said multiple switch elements.

8. A quadrature hybrid circuit, comprising:

four two-port circuits interconnected in a ring, four junction points of said four two-port circuits defining four ports, said four two-port circuits being configured so that a high frequency signal input to one of the four ports is output from two of the other ports at an equal level with a mutual phase difference of 90 degrees, and four variable reactance means connected to said four ports, respectively, for varying an operating frequency of the quadrature hybrid circuit, wherein each of said four variable reactance means includes multiple switch elements connected at one end thereof to corresponding one of said four ports, multiple reactance elements connected at one end thereof to the other ends of respective said multiple switch elements, and multiple capacitor elements grounding the other ends of respective said multiple reactance elements.

9. A quadrature hybrid circuit, comprising:

four two-port circuits interconnected in a ring, four junction points of said four two-port circuits defining four ports, said four two-port circuits being configured so that a high frequency signal input to one of the four ports is output from two of the other ports at an equal level with a mutual phase difference of 90 degrees, and four variable reactance means connected to said four ports, respectively, for varying an operating frequency of the quadrature hybrid circuit, wherein each of said four variable reactance means includes a respective serially connected circuit comprised of multiple serially connected reactance elements, a switch element that is connected between one end of said serially connected circuit and corresponding one of said four ports, and a ground switch means that is connected to each of said reactance elements on the end thereof opposite from said switch element, for grounding the high frequency signal.

10. A quadrature hybrid circuit, comprising:

four two-port circuits interconnected in a ring, four junction points of said four two-port circuits defining four ports, said four two-port circuits being configured so that a high frequency signal input to one of the four ports is output from two of the other ports at an equal level with a mutual phase difference of 90 degrees, and four variable reactance means connected to said four ports, respectively, for varying an operating frequency of the quadrature hybrid circuit, wherein each of said four variable reactance means includes a respective switch element that is connected on one end to a corresponding one of said four ports, and a respective reactance element connected to the other end of said corresponding switch element.

11. The quadrature hybrid circuit of any one of claims 10 to 6 and 1, wherein at least one of said four two-port circuits is composed of a respective lumped element circuit.

12. The quadrature hybrid circuit of any one of claims 10 to 6 and 1, further comprising:

a reactance controller for controlling the reactance of said four variable reactance means to change the operating frequency.

13. The quadrature hybrid circuit of any one of claims 10 to 6 and 1, wherein at least one of said four two-port circuits is composed of a respective transmission line.

14. The quadrature hybrid circuit of any one of claims 10 through 6, further comprising: four variable frequency matching circuits, each of said four variable frequency matching circuits being capable of impedance matching at multiple frequencies, and connected on one end to corresponding one of the junction points of said four two-port circuits, the other end of each of said variable frequency matching circuits serving as one of said four ports for said high frequency signal.

15. The quadrature hybrid circuit of claim 14, wherein each of said four variable frequency matching circuits comprises:

a respective impedance matching transmission line, one end of said impedance matching transmission line connected to corresponding one of the junction points of said four two-port circuits, and the other end of said impedance matching transmission line serves as one of said four ports for said high frequency signal, said respective impedance matching transmission line having a characteristic impedance equal to the port impedance of said quadrature hybrid circuit, and an impedance matching variable reactance means connected to said other end of said impedance matching transmission line.

* * * * *